US008816181B2

(12) United States Patent
Shemesh

(10) Patent No.: US 8,816,181 B2
(45) Date of Patent: Aug. 26, 2014

(54) ELECTRONIC PERCUSSION DEVICE AND METHOD

(71) Applicant: Guy Shemesh, Haifa (IL)

(72) Inventor: Guy Shemesh, Haifa (IL)

( * ) Notice: Subject to any disclaimer, the term of this patent is extended or adjusted under 35 U.S.C. 154(b) by 0 days.

(21) Appl. No.: 14/032,060

(22) Filed: Sep. 19, 2013

(65) Prior Publication Data

US 2014/0020547 A1 Jan. 23, 2014

Related U.S. Application Data

(62) Division of application No. 12/987,256, filed on Jan. 10, 2011, now Pat. No. 8,563,843.

(30) Foreign Application Priority Data

Jan. 13, 2010 (IL) ..... 203285

(51) Int. Cl.
*G10H 7/00* (2006.01)
*G10H 1/18* (2006.01)

(52) U.S. Cl.
USPC ..... 84/658; 84/615; 84/653

(58) Field of Classification Search
USPC ..... 84/615, 658, 653
See application file for complete search history.

(56) References Cited

U.S. PATENT DOCUMENTS 2,439,392 A * 4/1948 Jones ..... 250/233
4,242,937 A * 1/1981 Pozar ..... 84/725
4,817,485 A 4/1989 Bozzio et al.
5,345,037 A 9/1994 Nordelius
5,396,024 A 3/1995 Noguchi et al.
5,757,266 A * 5/1998 Rider et al. ..... 340/323 R
5,837,915 A 11/1998 Suenaga
5,920,026 A 7/1999 Yoshino et al.
5,977,473 A 11/1999 Adinolfi
6,031,176 A 2/2000 Tanaka
6,756,535 B1 6/2004 Yoshino et al.
6,815,602 B2 11/2004 De Franco
6,921,857 B2 7/2005 Yoshino et al.
7,271,328 B2 * 9/2007 Pangrle ..... 84/464 R
7,385,135 B2 6/2008 Yoshino et al.
7,396,991 B2 7/2008 Susami
7,525,032 B2 4/2009 Mishima
7,569,758 B2 8/2009 Harada et al.
7,612,273 B2 * 11/2009 Matsuyuki et al. ..... 84/411 R
7,667,130 B2 * 2/2010 Mishima ..... 84/723
8,071,871 B2 12/2011 Peavey
8,173,886 B2 5/2012 Hashimoto
8,378,203 B2 * 2/2013 Wallace et al. ..... 84/733
8,431,813 B2 4/2013 Mori (Continued)

*Primary Examiner* — David S. Warren
(74) *Attorney, Agent, or Firm* — Holtz Holtz Goodman & Chick PC

(57) ABSTRACT

An electronic percussion device includes a drum shell, a drumhead as striking surface, vibration sensors, and a peripheral and a central vibration carrier. The vibration carriers abut against the drumhead to convey vibrations therefrom to the sensor(s). The central vibration carrier is a helicoidal spring. The peripheral vibration carrier is a rigid body of solid material supported by peripheral sensors disposed thereunder. Two electrical leads of each one of the peripheral sensors are correspondingly coupled in parallel to produce only two common output leads. An electronic sound module is configured to sample the sensors and employs software procedures to detect percussion strokes delivered on the drumhead, and to generate sounds accordingly. The software procedures use averaged and aggregated signals to provide accurate detection of position and intensity of a drum stroke. Alternative embodiments of the device use only a peripheral vibration carrier or only a central vibration carrier.

5 Claims, 21 Drawing Sheets

(56) References Cited

U.S. PATENT DOCUMENTS

| | | | | |
|---|---|---|---|---|
| 8,554,348 | B2 * | 10/2013 | Gehring et al. | 700/94 |
| 8,563,843 | B1 * | 10/2013 | Shemesh | 84/743 |
| 8,586,853 | B2 * | 11/2013 | Sakazaki | 84/743 |
| 2003/0188629 | A1 * | 10/2003 | Suenaga | 84/723 |
| 2004/0118269 | A1 * | 6/2004 | Yoshino | 84/723 |
| 2004/0200338 | A1 * | 10/2004 | Pangrle | 84/724 |
| 2004/0211310 | A1 | 10/2004 | Hagiwara et al. | |
| 2005/0150366 | A1 | 7/2005 | Susami | |
| 2005/0223880 | A1 | 10/2005 | Yoshino et al. | |
| 2006/0174756 | A1 * | 8/2006 | Pangrle | 84/724 |
| 2006/0219092 | A1 * | 10/2006 | Mishima | 84/724 |
| 2007/0051231 | A1 | 3/2007 | Fujii | |
| 2007/0234886 | A1 * | 10/2007 | Matsuyuki et al. | 84/723 |
| 2008/0238448 | A1 * | 10/2008 | Moore et al. | 324/686 |
| 2009/0000464 | A1 * | 1/2009 | Mishima | 84/724 |
| 2009/0229450 | A1 | 9/2009 | Hashimoto | |
| 2010/0107858 | A1 | 5/2010 | Peavey | |
| 2010/0282047 | A1 | 11/2010 | Hashimoto et al. | |
| 2011/0015766 | A1 * | 1/2011 | Gehring et al. | 700/94 |
| 2011/0162513 | A1 * | 7/2011 | Mizuhiki | 84/622 |
| 2012/0024132 | A1 * | 2/2012 | Wallace et al. | 84/689 |
| 2012/0073425 | A1 | 3/2012 | Hashimoto | |
| 2012/0137858 | A1 * | 6/2012 | Sakazaki | 84/723 |
| 2012/0216667 | A1 * | 8/2012 | Sakazaki | 84/725 |
| 2012/0222542 | A1 | 9/2012 | Hashimoto | |
| 2013/0118338 | A1 * | 5/2013 | Wallace et al. | 84/626 |
| 2013/0239787 | A1 * | 9/2013 | McMillen et al. | 84/643 |
| 2013/0340598 | A1 * | 12/2013 | Marquez et al. | 84/730 |
| 2014/0020547 | A1 * | 1/2014 | Shemesh | 84/626 |
| 2014/0020548 | A1 * | 1/2014 | Shemesh | 84/626 |

* cited by examiner

ELECTRONIC PERCUSSION DEVICE AND METHOD

This is a Divisional of U.S. application Ser. No. 12/987,256, filed Jan. 10, 2011, the entire contents of which are incorporated herein by reference.

TECHNICAL FIELD

The present invention relates to electronic percussion instruments, such as drums and cymbals, and in particular, to electronic percussion devices able to detect the position and the intensity of a stroke, either on the drumhead or on the drum rim, and output prerecorded sounds in accordance with the detected stroke position and intensity.

RELATED ART

The related art may roughly be categorized into two portions, namely a first portion regarding inventions that involve a striking surface able to vibrate, such a mesh head, and a second portion where the striking surface is made of rubber. It is well known that the second portion is considered inferior because the "feel" of playing while striking on rubber does not compare to the striking on a vibrating surfaces, since the drumstick barely bounces back from a rubber surface. The introduction of quiet vibrating striking surfaces such as mesh heads is a huge step in the continued efforts of modeling acoustic percussion devices.

However there are several other issues that need be addressed when modeling behavior of acoustic drums. First, the delay in sound reproduction in response to a trigger must go un-noticed even to the trained ear of a musician. Referring to the related art, generation of sound starts only after the determination of maximum stroke velocity. With the related art, this delay was measured on mesh heads to exceed 1 millisecond from the start of vibration signal and until the occurrence of first maximum. Adding to the system delays of the sound reproduction processes, A/D and D/A conversions one can easily exceed a 2 millisecond delay, which is considered perceivable to a trained ear. The related art does not address this problem at all, even though trained musicians actually recognize small delays while playing electronic percussion instruments.

U.S. Pat. Nos. 5,920,026 and 6,756,535, both by Yoshino et al., referred to hereinbelow as Yoshino, teach details of the construction of an electronic drum with a mesh-like head. Furthermore, Yoshino also discloses a method for detecting the position of a stroke hitting the drumhead. Position sensing is achieved by measuring the time of the first half wave signal sampled on the center sensor.

Although this method will work in general, it is extremely susceptible to noises and to variances in stroke intensity that leads to only a rough estimate of stroke position.

U.S. Pat. No. 6,031,176 to Tanaka, referred to hereinbelow as Tanaka, discloses the construction of a striking apparatus with two sensors acting as ON-OFF switches, the one connecting to the center of the apparatus and the other to the rim. These sensors allow for differentiating between three different sound zones, the first being the center in which only the center sensor is 'ON', the second being the rim in which on the rim sensor is 'ON' and the third is a combination of the two in which both sensors are 'ON'. However, Tanaka teaches a method that allows the output of only three different sounds at best, where in the usual case there will be only one sound output as drum players mostly use normal strokes on the drumhead.

U.S. Pat. No. 7,396,991 to Susami, referred to hereinbelow as Susami, teaches the usage of two sensors for the application rim shot detection. Susami divulges one sensor being positioned under the center of the head and detecting vibrations from the mesh, and the other sensor being mounted in the center of the mounting plastics (the plastics that hold both sensors into place) and receiving vibrations from the rim area through ribs located in the plastics. Rim shot detection is achieved by comparing maximum intensities measured on head and rim sensors. With Susami, the striking detection section 1 is also furnished with the rim shot sensor 31 that detects the striking of the rim 6 and the head sensor 21 that detects the striking of the head 5. However, Susami only recites head and rim shot sensing, not positional sensing.

U.S. Pat. No. 6,815,602 by De Franco, referred to hereinbelow as De Franco, discloses a percussion instrument in which accurate positional detection is achieved by using a resistive membrane switch located below a layer of rubber, effectively forming a variable sized resistor which changes it's resistance as function of stroke location. The instrument is further equipped with a piezo-electric sensor for complementing the position information with stroke velocity information. The two sensors output are then inserted into a controller board that is installed inside the instrument embodiment and the resulting output from the controller is a MIDI signal transferred to a computer for sound reproduction. Of all the related art disclosures, De Franco is the only one to accurately achieve position detection however this comes at a price. First, the cost of producing such an instrument is significant since it is a complex device comprised of several layers and having a special controller board installed per each drum. Second, the drumhead used is a rubber material so percussion feeling is not as good as a vibrating drumhead or mesh and third, there is no rim shot capability.

U.S. Pat. No. 5,345,037 by Nordelius, teaches a vibration sensitive body which is designed to bear against the drumhead, the wave motion of which is intended to be detected and picked up. The vibration sensitive body is positioned on and protrudes above and mainly in a plane parallel to the drumhead.

Another problem that has not been addressed in the related art is the lack of linearity in detection of stroke intensity or velocity as function of position. It turns out that mounting a single sensor under the center of the drumhead, as disclosed by Yoshino and Susami has a problem when a direct stroke is applied in the center of the drum directly above the sensor's cushioning member. Such a stroke induces a far greater voltage at the sensor's output than a stroke of equal intensity struck on other locations of the mesh head. Due to this fact there exists a circular area at the center of the drum, having a radius of about 1.5 cm in which sounds are output very loudly when compared to other areas on the drumhead, thereby adversely affecting the realism and feel of playing the instrument.

SUMMARY

It is an object of the present invention to provide an electronic percussion device for an electronic percussion instrument system and a method for providing a vibration carrier with an electronic percussion device. The electronic percussion device may include a drum shell having a top opening and a shell interior, a drumhead providing a striking surface and a drumhead bottom surface disposed opposite thereto, where the striking surface is stretched over the top opening of the drum shell and is configured to receive a percussion stroke thereon. The electronic percussion device may further include a sensors support coupled to the drum shell in the interior thereof, and at least one sensor disposed on the sensors support. The peripheral carrier is disposed in the shell interior and is configured as a rigid body made out of solid material, having a peripheral carrier top edge and a peripheral carrier bottom edge, where the peripheral carrier bottom edge is supported by the at least one sensor disposed thereunder, and the peripheral carrier top edge is coupled to and biased by the drumhead bottom surface towards the at least one sensor. Thereby the peripheral carrier is configured to transmit vibrations received on the striking surface to the at least one sensors.

It is another object of the present invention to provide the peripheral carrier with a top edge that abuts in contact against at least one portion of the drumhead bottom surface. The peripheral carrier top edge abuts against the drumhead bottom surface to form a predetermined path of contact via which vibrations induced in the drumhead are communicated to the peripheral carrier and to the at least one sensor If desired, the predetermined path of contact may form the shape of a closed curvilinear path.

It is yet an object of the present invention to configure the peripheral carrier as a rigid hollow body made of solid material that extends from the drumhead bottom surface to the at least one sensor, and to dispose the peripheral carrier top edge sufficiently adjacent to the drum shell to avoid percussion strokes impinging directly thereover. The peripheral carrier is biased by the drumhead onto the at least one sensor which is disposed on the sensors support in a configuration allowing at least one degree of freedom of motion of the peripheral carrier, which vibrates and communicates vibration.

It is still an object of the present invention for the at least one sensor to include a plurality of sensors, where each one sensor out of the plurality of sensors has a first lead and a second lead. The first leads of the plurality of sensors are electrically coupled to form a common first lead, the second leads of the plurality of sensors are electrically coupled to form a common second lead, and a single electrical output signal derived from the plurality of sensors is communicated via the common first lead and the common second lead. Moreover, a central sensor is disposed on the sensors support, and a central carrier that is disposed on the sensors support comprises a mechanical spring having a first end and a second end, where the spring first end is coupled to the central sensor and the spring second end is biased against the drumhead bottom surface.

It is furthermore an object of the present invention to provide an electronic percussion device in an electronic percussion system. The electronic percussion device may comprise: a drum shell having a top opening as an open first end, and a drumhead disposed in tension across the open top opening to define a striking surface for receiving thereon a percussion stroke that induces vibrations in the drumhead. The electronic percussion device may further include a bottom surface of the drumhead facing opposite the striking surface, and a first means configured as rigid body made of solid material for receiving and transmitting vibrations from the drumhead, where the first means abuts against the bottom surface in a plurality of locations. In addition, the electronic percussion device may also have a second means configured for receiving vibrations from the first means and for generating an electrical signal in response to vibrations, with the first means being disposed on the second means, whereby vibration induced on the drumhead is communicated from the plurality of locations to produce a single electrical signal.

It is still an object of the present invention to ascertain that the plurality of locations at which the drumhead abuts against the first means are selected to be sufficiently close to the drum shell to avoid a percussion stroke directly over the first means.

One more object of the present invention is to provide first means having a top edge in the shape of an annulus which abuts against the drumhead bottom surface.

Another object of the present invention is to provide second means that includes a plurality of sensors, where each sensor out of the plurality of sensors has a first lead and a second lead, and where the first leads of the plurality of sensors are electrically coupled to form a common first lead, the second leads of the plurality of sensors are electrically coupled to form a common second lead, and a single electrical output signal derived from the plurality of sensors is communicated via the common first lead and the common second lead.

An additional object of the present invention is to provide a central sensor disposed in the drum shell that is configured to generate an electrical signal in response to vibration, and a third means abutting against the bottom surface that is configured for communicating vibrations received from a center of the drumhead to the central sensor via solid material. The third means is supported by the central sensor and comprises a mechanical coil spring, which abuts against the drumhead bottom surface.

It is yet another object of the present invention to provide a method for detecting a radial position and an intensity of a percussion stroke induced in an electronic percussion device, and for generating an electrical signal of a percussion sound which correspond to the detected position and the intensity of the percussion stroke. The method comprises providing a drumhead having a striking surface for receiving vibrations induced by the percussion stroke, where the drumhead has a bottom surface opposite the striking surface, and providing an electrical first signal in response to vibrations received on the drumhead and collected at a center thereof. The method further comprises the steps of providing an electrical second signal in response to vibrations received on the drumhead and collected thereon from a plurality of locations which are distributed at equal and a predetermined distance away from the center of the drumhead, and providing an electronic module, comprising a processor and a memory, for receiving the first and the second signals and for producing an output signal in response to the first and the second signals. The method also comprises computing a radial location of the percussion stroke on the drumhead based on detection of a time of arrival of the first signal and of the second signal, and computing the intensity of the percussion stroke as a weighted sum of a maximum amplitude of the first signal and of the second signal. Finally, the method comprises generating an electrical signal representative of a percussion sound by using the computed radial location and intensity of percussion to select and sound at least one pre-recorded percussion sound that was stored a priori in memory.

It is one more object of the present invention to provide the method for detecting a radial position with further steps, such as detecting the time of arrival of the percussion stroke on the first signal, and detecting the time of arrival of the percussion stroke on the second signal. The further steps also include computing a radial distance result by applying a proportion factor to a difference in time of arrival of the percussion stroke on the first signal and on second signal, and adding half of the predetermined distance.

It is still one more object of the present invention to provide the method for calculating the radial location with further steps, such as deriving a radial location of the percussion stroke received on the striking surface by application of a computer program for computation of equation $R0=R*(t1-t2+T)/(2*T)$, wherein R0 is the resultant radial location, defined as the distance separating the drumhead center away from the percussion stroke location, R is the predetermined distance, t1 is the time of detection of the percussion stroke on the first signal, t2 is the time of detection of the percussion stroke on the second signal, and T is a predetermined constant. The predetermined constant T may be set, either in factory at the manufacturing stage, or by the user when operating a calibration procedure. It is yet still another object of the present invention to provide the method for calculating the intensity of the stroke to further comprise the steps of detecting a first amplitude as the maximum amplitude of the percussion stroke received on the first signal, detecting a second amplitude as the maximum amplitude of the percussion stroke received on the second signal, and computing a normalized radial location having a value ranging between zero and one by dividing the radial location result by the predetermined distance. Still further steps include setting a proportion ratio as a predetermined constant for compensating differences in signal amplification of the first signal and of the second signal, and calculating the intensity of the stroke as a sum of a first term and of a second term, the first term being a multiplication of the first amplitude with the normalized radial location and the second term being a multiplication of three sub-terms, the first sub-term being the second amplitude, the second sub-term being one minus the normalized radial location, and the third sub-term being the proportion ratio.

It is an additional object of the present invention to provide the method for calculating the intensity of the stroke to further comprise the steps of deriving an intensity of the percussion stroke received on the striking surface by application of the at least one computer program for computation of equation $I=(R0*Ic+A*(R-R0)*Ip)/R$, wherein:

I is the calculated intensity of the percussion stroke,

A is a predetermined constant for compensating differences in signal amplification of the first signal and of the second signal, R0 is the resultant radial location, defined as the distance separating the drumhead center away from the percussion stroke location, R is the predetermined distance, Ic is a detected maximum amplitude of the percussion stroke received on the first signal, and Ip is a detected maximum amplitude of the percussion stroke received on the second signal.

It is yet one more object of the present invention to provide a method for detecting a location of a percussion stroke impinging on an electronic percussion device having a drumhead and a rim, where the percussion stroke is received on the drumhead or on the rim, and generating in response a corresponding percussion sound signal. The method comprising the steps of providing a peripheral carrier for receiving vibrations from a plurality of locations on the drumhead, and providing an electrical signal in response to vibrations received from the peripheral carrier, where the electrical signal has an equilibrium level at which no vibrations are detected, thus void of vibrations. The method further comprises the steps of determining whether the percussion stroke impinges on the drumhead or on the rim by one of the steps of:

(i) examining the received electrical signal at an initial moment of reception of the stroke, and in case the signal is rising above the equilibrium level, determining that the stroke was induced on the drumhead, (ii) examining the received electrical signal at the initial moment of reception of the stroke, and in case the signal is falling below the equilibrium level, determining that the stroke was induced on the rim.

Moreover, the method comprises the step of generating a corresponding percussion sound signal in response to reception of the percussion stroke on the drumhead or on the rim.

BRIEF DESCRIPTION OF THE DRAWINGS

Non-limiting embodiments of the invention will be described with reference to the following description of exemplary embodiments, in conjunction with the figures. The figures are generally not shown to scale and any measurements are only meant to be exemplary and not necessarily limiting. In the figures, identical structures, elements, or parts that appear in more than one figure are preferably labeled with a same or similar number in all the figures in which they appear, in which.

DETAILED DESCRIPTION

The description of the embodiments of the present invention, which relates to electronic percussion systems EPS, is best understood with reference to FIGS. 1-25.

Figure 20:
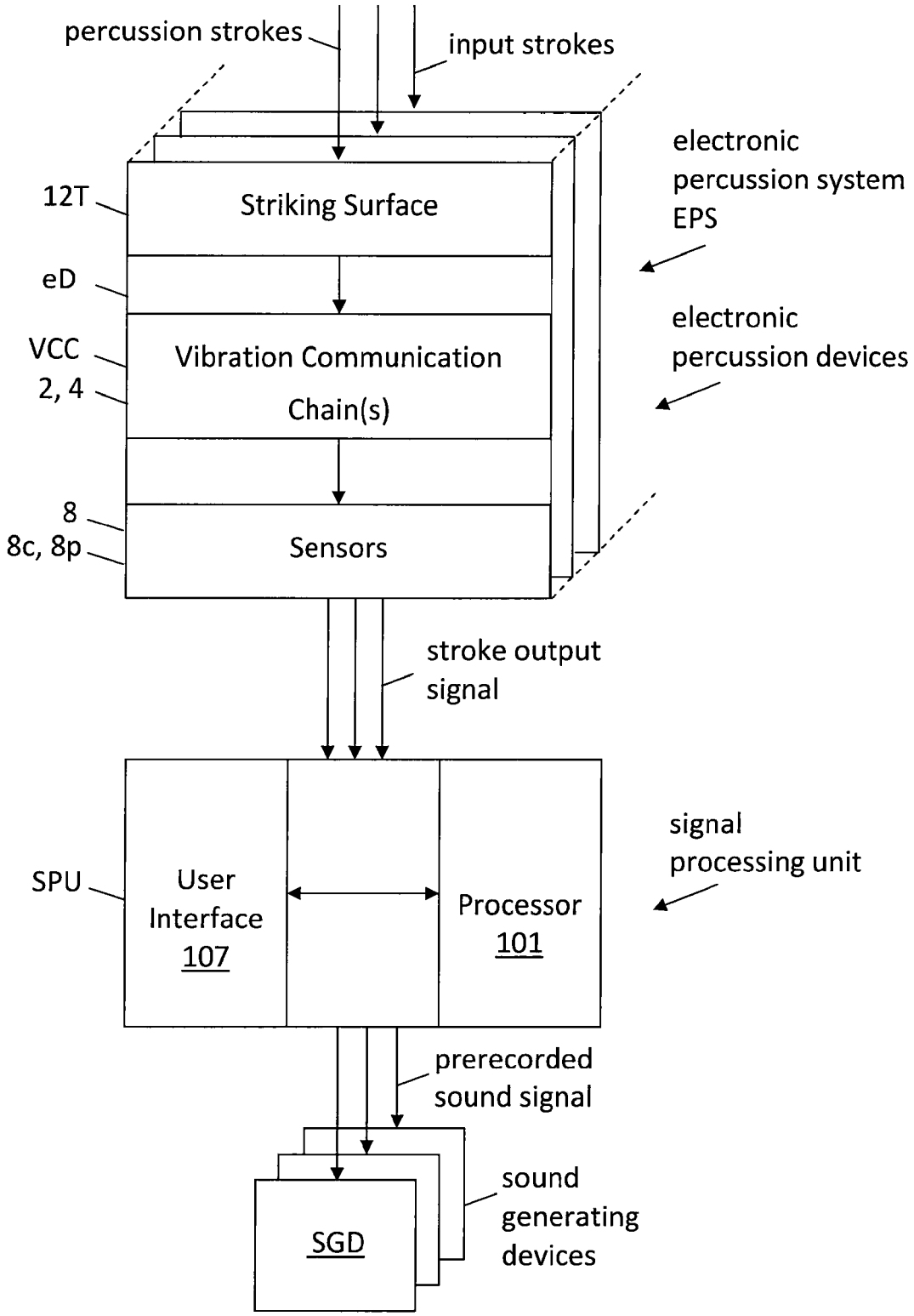
FIG. 20 is a block diagram of an electronic percussion system including a plurality of electronic percussion devices.

FIG. 20 is a block diagram of an electronic percussion system EPS including a plurality of electronic percussion devices eD, e.g. drums, a signal processing unit SPU, and at least one sound generating device SGD such as a loudspeaker and/or earphones. Percussion, or input strokes delivered by a user and received onto a striking surface 12 of a percussion device eD, generate vibrations that are communicated by one or more vibration communication chain(s) VCC to respectively, one or more vibration sensor(s) 8, which in turn, deliver stroke output signals in the form of analog electric output signals. In other words, the sensors 8 transform wave motions generated by hits on the drumhead 12 into analog electrical signals. The stroke output signals from the sensor(s) 8 are communicated to the signal-processing unit SPU, which includes at least one processor 101 coupled to, but not shown in FIG. 20, at least one memory configured for storing computer programs, instructions, and data, and at least one computer program stored in memory in a form readable and executable by the processor for executing instructions. The task of the signal processing unit SPU is to receive and analyze the stroke output signals received from the sensor(s) of the percussion devices eD, and in response, to output suitable prerecorded percussion sounds to one or more appropriate sound-generating device(s) SGD. This means that the signal processing unit SPU is configured for executing instructions operative for deriving a corresponding percussion sound in response to the received electrical signal generated by an percussion stroke impinging on the electronic percussion device eD.

In the description hereinbelow, a percussion, or input stroke is considered as a hit, a percussion, a blow, a rap or other synonyms that refer to actions that induce vibration in the electronic percussion devices eD. Likewise, a drumstick is also meant to refer to a brush or any other implement used by a percussionist for inducing vibration in the electronic percussion devices eD.

Furthermore, the signal processing unit SPU has a user interface, which allows the percussionist to control and adjust the sounds being played and to calibrate the system on first use, or as needed. The SPU user interface may include a display, buttons, and knobs for the purpose of adjustment and calibration.

Figure 1:
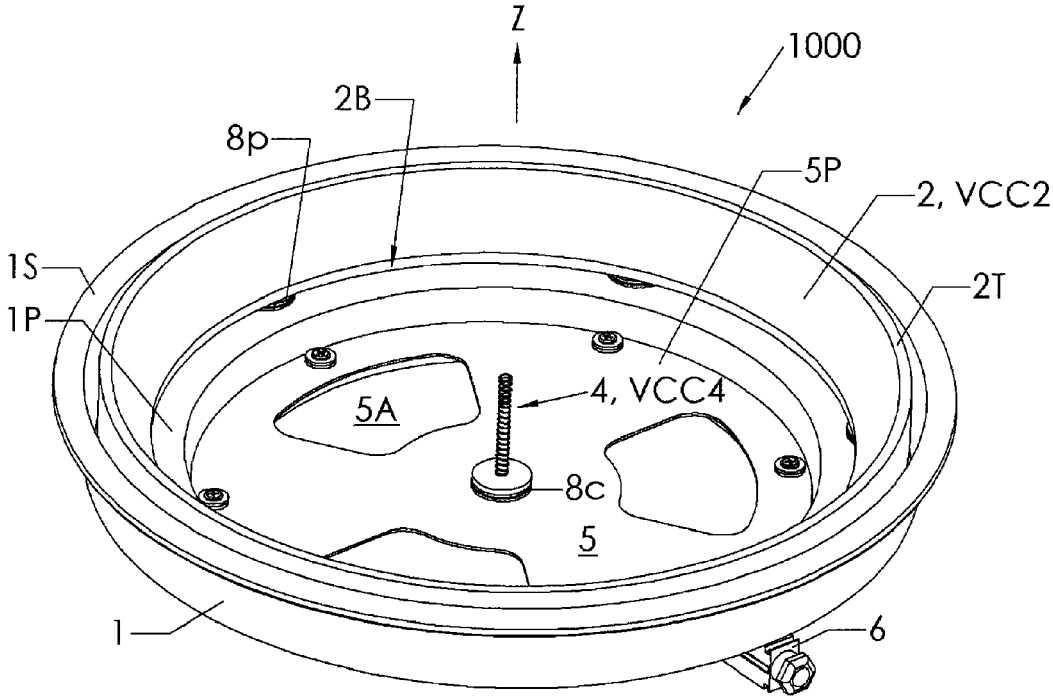
FIG. 1 depicts a portion of the electronic percussion device.

FIGS. 1-3D illustrate an exemplary structure of an electronic percussion device eD in accordance with a first embodiment 1000 of the present invention. FIG. 1 depicts a portion of the electronic percussion device eD, which is shown in exploded view in FIG. 2. FIG. 3A is a cross-section of the electronic percussion device eD, while enlarged details of FIG. 3A are presented in FIGS. 3B, 3C, and 3D.

Figure 2:
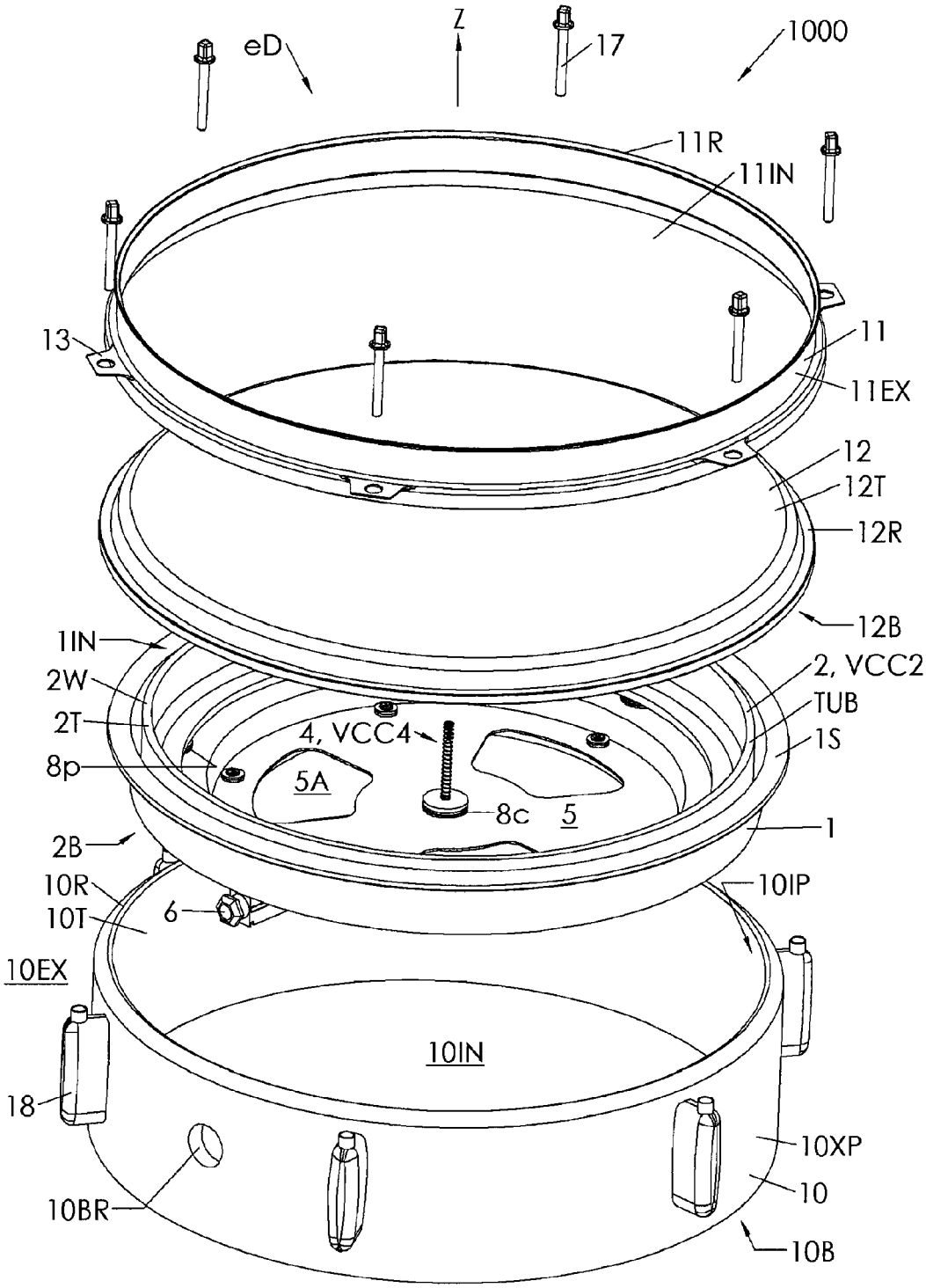
FIG. 2 shows an exploded view of an embodiment of the electronic percussion device.

In FIG. 2, the electronic percussion device eD is shown to include a substantially cylindrical drum shell 10, having a top opening 10T, a shell upper edge 10R, a shell exterior 10EX, a shell interior 10IN, an exterior periphery 10XP and an interior periphery 10IP. Typically, the drum shell 10 may be made of wood or steel, but may also be made out of any other suitable solid material.

The drum shell 10 may be configured as a base whereon other components of the electronic percussion device eD are mounted. Usually, the exterior periphery 10XP of the drum shell 10 holds lugs 18 that are fixedly coupled thereto in equally spaced apart distribution. Each lug 18 has a bore with a female screw thread, where the bore is configured for receiving a male drum bolt 17 therein, as further described hereinbelow.

With the first embodiment 1000, the top opening 10T of the drum shell 10 is configured for receiving a sensors support 1 holding two vibration communication chains VCC, namely VCC2 and VCC4, into the shell interior 10IN of the drum shell. FIG. 2 illustrates two vibration communication chains VCC, which are used to communicate vibrations from the striking surface 12, or striking surface top 12T to the sensors 8. The vibration communication chain VCC2 has a peripheral vibration carrier 2, or peripheral carrier 2 for short, and the vibration communication chain VCC4 has a central vibration carrier 4, or central carrier 4. The peripheral carrier 2 is supported by one or by a plurality of peripheral sensors 8*p* and the central carrier 4 is supported by a center sensor 8*c*. The peripheral carrier 2 is thus biased by the drumhead 12 against the at least one sensor 8 which is disposed on the sensors support 1 in a configuration allowing at least one degree of freedom of motion of the peripheral carrier, which vibrates and communicates vibration. It is noted that a vibration communication chain VCC is made out of solid material and may include a single one or more than one mechanical part.

The denominations top, upper, above, and derivatives thereof refer to portions of the electronic percussion device eD disposed higher up, where the striking surface 12 is considered to be disposed above the other elements, just below the rim 11 such as the vibration communication chains VCC and the sensors 8 disposed further down.

The sensors support 1 bearing the two vibration communication chains VCC may be introduced into the top opening 10T, later covered by the drumhead 12, on top of which the rim 11 is firmly, attached. The drumhead 12 has on one side a top striking surface 12T that receives the percussion strokes of the percussionist and on the other side, of the drumhead 12, a drumhead bottom surface 12B disposed opposite thereto and facing the shell interior 10IN 0. The periphery of the drumhead 12 is belted by a drumhead ring 12R. The drumhead 12 is preferably made out of any suitable matter or material able to vibrate when hit by a drumstick.

The peripheral carrier 2 may be disposed in pressure contact, thus firm abutting contact against the bottom portion 12B of the drumhead 12. The drumhead 12 is stretched over both the peripheral carrier 2 and the sensors support 1 and is firmly retained by an annular rim 11, or by any other mechanical retention means that is mounted on top of the drumhead ring 12R, to secure the drumhead 12 in place. In other words, the rim 11 is configured for stretching and for retaining the drumhead 12 in a tensioned state. The rim 11 has a rim interior 11IN, a rim exterior 11EX, a rim edge 11R, and a configuration adapted for matching engagement with the drumhead ring 12R and with the drum shell 10.

Bored protrusions 13 are disposed in equally spaced apart distribution on the rim exterior 11EX of the rim 11. The distribution of the bored protrusions 13 is selected to match the distribution of the lugs 18, to allow male drum bolts 17 to be introduced through the bored protrusions and to engage the lugs in adjustable screw-threaded coupling. Inserting the drum bolts 17 through the bored protrusions and controllably tightening the drum bolts 17 in adjustable engagement with the lugs 18 will successively press the rim 11 onto the drumhead ring 12R and onto the sensors support 1, to firmly couple with the drum shell 10. Thereby, the bottom portion 12B of the drumhead 12 will be stretched taut against the peripheral carrier 2 and the sensors support 1. Hence, the peripheral carrier 2 is disposed intermediate and under light pressure in firm abutting contact against the drumhead 12 and in firm assembly against and on top of the sensors 8*p*. Thereby, the peripheral carrier 2 communicates vibrations from the drumhead 12 or from the rim 11, to the plurality of sensors 8*p*. The sensor support 1 itself is biased by the stretched drumhead 12 against the shell 10, to be retained in place in the interior 10IN of the drum shell 10.

Referring to FIGS. 1 and 2, the sensor support 1 is shown to hold two vibration communication chains VCC, namely VCC2 and VCC4, configured respectively as the peripheral carrier 2 and the central carrier 4. The sensor support 1 may be configured as a generally annular structure supporting the peripheral vibration carrier 2.

Figure 3D:
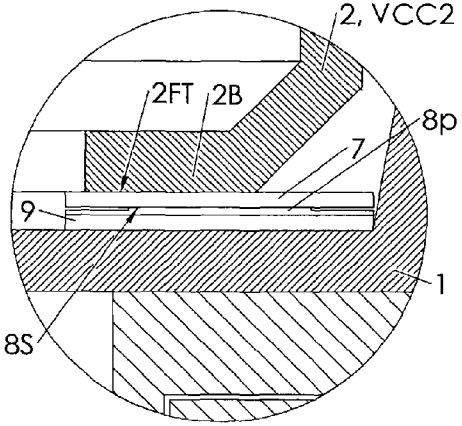
FIGS. 3B, 3C, and 3D present details of FIG. 3A.
Figure 3C:
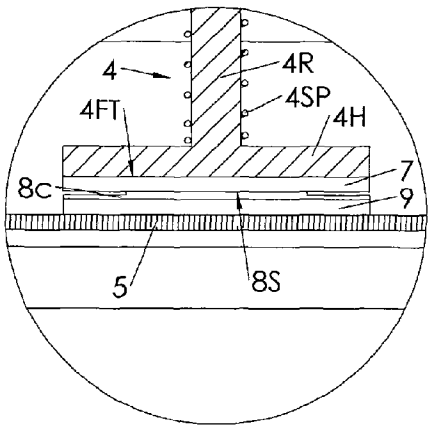
Figure 3B:
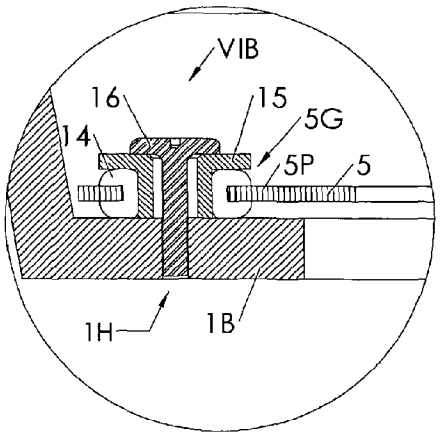
Figure 3A:
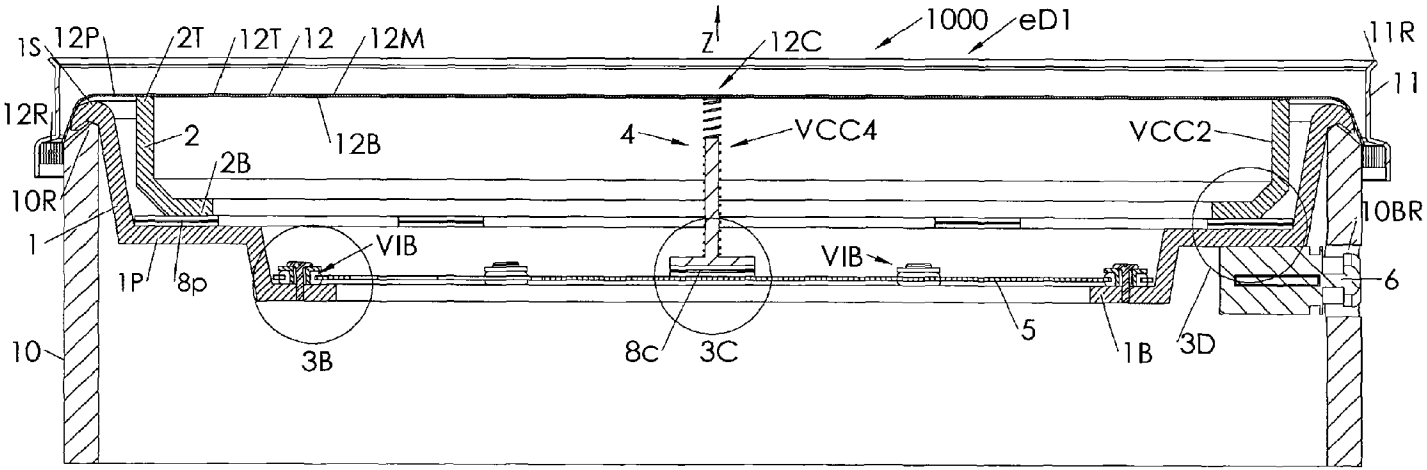
FIG. 3A is a cross-section of the electronic percussion device.

The peripheral carrier 2, may be hollow and configured as an open tubular structure or tubular carrier body TUB, having a carrier top edge 2T that abuts against the bottom portion 12B of the drumhead 12 but may have a degree of freedom of motion, thus be able to vibrate, and has a bottom edge 2B shown in FIG. 3A. The peripheral carrier top edge 2T abuts in contact against at least one portion of the drumhead bottom surface 12B, which at least one portion that is in contact with the drumhead bottom surface forms a predetermined path of contact. The predetermined path of contact is configured to communicate vibrations induced in the drumhead 12 to the peripheral carrier 2 and to the at least one sensor 8. The predetermined path of contact may be linear or form a shape having a closed curvilinear curve, such that the path of contact may take the shape of an open or a closed curvilinear path. The peripheral carrier 2 may be configured as a rigid hollow body made of solid material extending from the drumhead bottom surface 12B to an at least one sensor 8, and be disposed sufficiently adjacent to the drum shell to avoid percussion strokes impinging directly thereover.

The sensor support 1, which supports the plurality of peripheral sensors 8*p*, holds a mounting plate 5 that may be coupled to the bottom portion 1B of the sensor support 1, shown in FIG. 3A. Apertures 5A opened in the mounting plate 5 permit unimpeded passage of air, allowing vibration of the drumhead 12. Furthermore, the mounting plate 5 supports the center sensor 8*c*, and may be, but is not necessarily, disposed at the center of the sensor support 1. The center sensor 8*c* is shown to hold the vibration communication chains VCC4, configured as the central vibration carrier 4, which is disposed on the mounting plate 5, and which abuts in firm contact against the bottom portion 12B of the drumhead 12. One female electrical connector 6, or output plug 6, is preferably coupled to the bottom portion 1B of the sensors support 1 and is accessible from the shell exterior 10EX via a drum shell bore 10BR, disposed in the drum shell 10, as shown in FIG. 3A.

FIGS. 1 to 3A shows an axis Z passing through the center of, and along which are stacked the structural elements of the electronic percussion device eD, including the drum shell 10, the sensors support 1, the peripheral vibration carrier 2, the drumhead 12, and the rim 11. All the structural elements have a center, and when stacked into assembly, all those centers are aligned along the axis Z.

Although depicted as having a carrier top edge 2T of circular shape, the electronic percussion device eD will perform well when having other top edge selected shapes. For example, instead of being circular, the carrier top edge 2T and the peripheral vibration carrier 2 may have any desired and practical closed loop curve shape. Thus, the electronic percussion device eD and the peripheral vibration carrier 2 may be elliptical or even polygonal and have a convex polygon shape, like a pentagon, a hexagon, or an octagon for example. This means that the sensors support 1 and the peripheral carrier 2 may have the same or a different shape. Although not depicted in the Figs., both the sensors support 1 and the peripheral carrier 2 may for example be chosen as a hexagon, both centered about the axis Z and having mutual parallel sides. Nevertheless, the electronic percussion device eD will also perform when the shape of the sensors support 1 and of the peripheral carrier 2 is different. For example, the sensors support 1 may be a hexagon while the sensors support 1 is a pentagon, both aligned about the axis Z.

Regardless of the selected configuration, a predetermined path of contact is formed by abutment of the peripheral carrier top edge 2T against the drumhead bottom surface 12B.

The peripheral carrier 2 is smaller in dimensions than the drumhead bottom surface 12B against which it abuts and the center of which is disposed on the axis Z as is the center of the drumhead center 12C of the striking surface 12. Preferably, the peripheral carrier top edge 2T is disposed close to the rim 11. The peripheral carrier 2 divides the striking surface 12 into two portions: one first portion is the striking surface main portion 12M which extends away from the drumhead center 12C and up to the peripheral carrier 2. The second portion is the striking surface peripheral portion 12P extending away from the striking surface main portion 12M and up to the rim 11.

Figure 6:
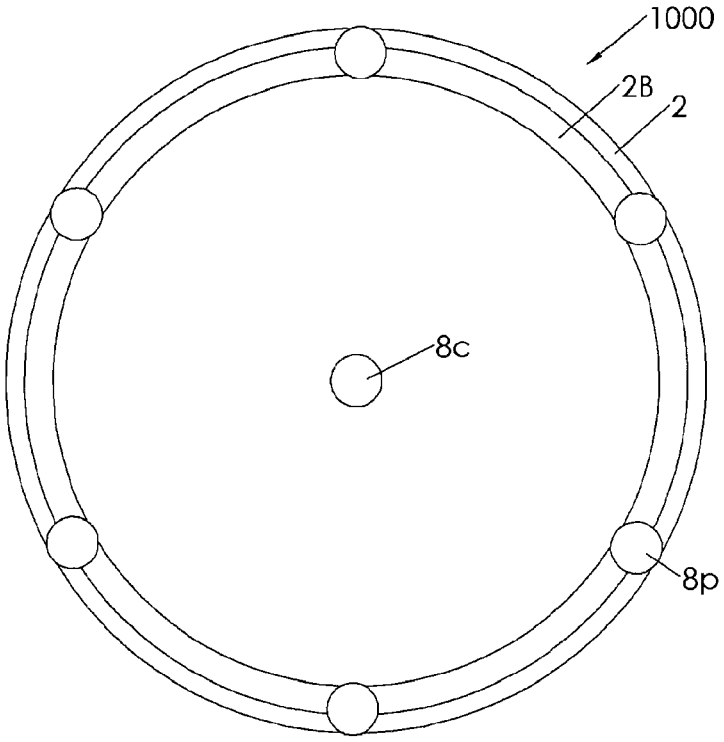
FIG. 6 is a bottom view showing the disposition of the peripheral sensors and of the center sensor.

The disposition of the peripheral sensors 8*p* and of the center sensor 8*c* is best seen in FIG. 6, which is a bottom view seen from the side of the sensors 8*c* and 8*p* in the direction of the peripheral vibration carrier 2 where the sensors support 1 is removed. The peripheral sensors 8*p* may be disposed in equally or unequally separated apart angular distribution on a platform 1P of the sensors support 1, as shown in FIG. 3A, or in support of the peripheral carrier bottom edge 2B of the peripheral vibration carrier 2, as shown in FIG. 6. In total, there may be three or more such sensors. As shown in FIG. 6, there are six peripheral sensors 8*p* distributed in circular symmetry, in even angular distanced distribution disposed below and in support of the vibration communication chain VCC2. However, it may suffice to have only one sensor 8*p* and one or two studs forming dummy sensors, to provide stable support of the peripheral vibration carrier 2.

It is noted that all the peripheral sensors 8*p* are mutually coupled together by the rigid peripheral carrier 2 in a mechanical vibration communication path made out of solid material. The peripheral carrier 2 may be made out of at least one unitary piece of solid material, such as plastic, metal, or wood for example. Thereby, the peripheral carrier 2 provides a mechanical vibrations chain VCC2 for communication of vibrations via a path of solid material, from the drumhead 12 to the peripheral sensors 8*p*. Thus, vibrations of the striking surface 12 are communicated to the peripheral sensors 8*p*.

Figure 21:
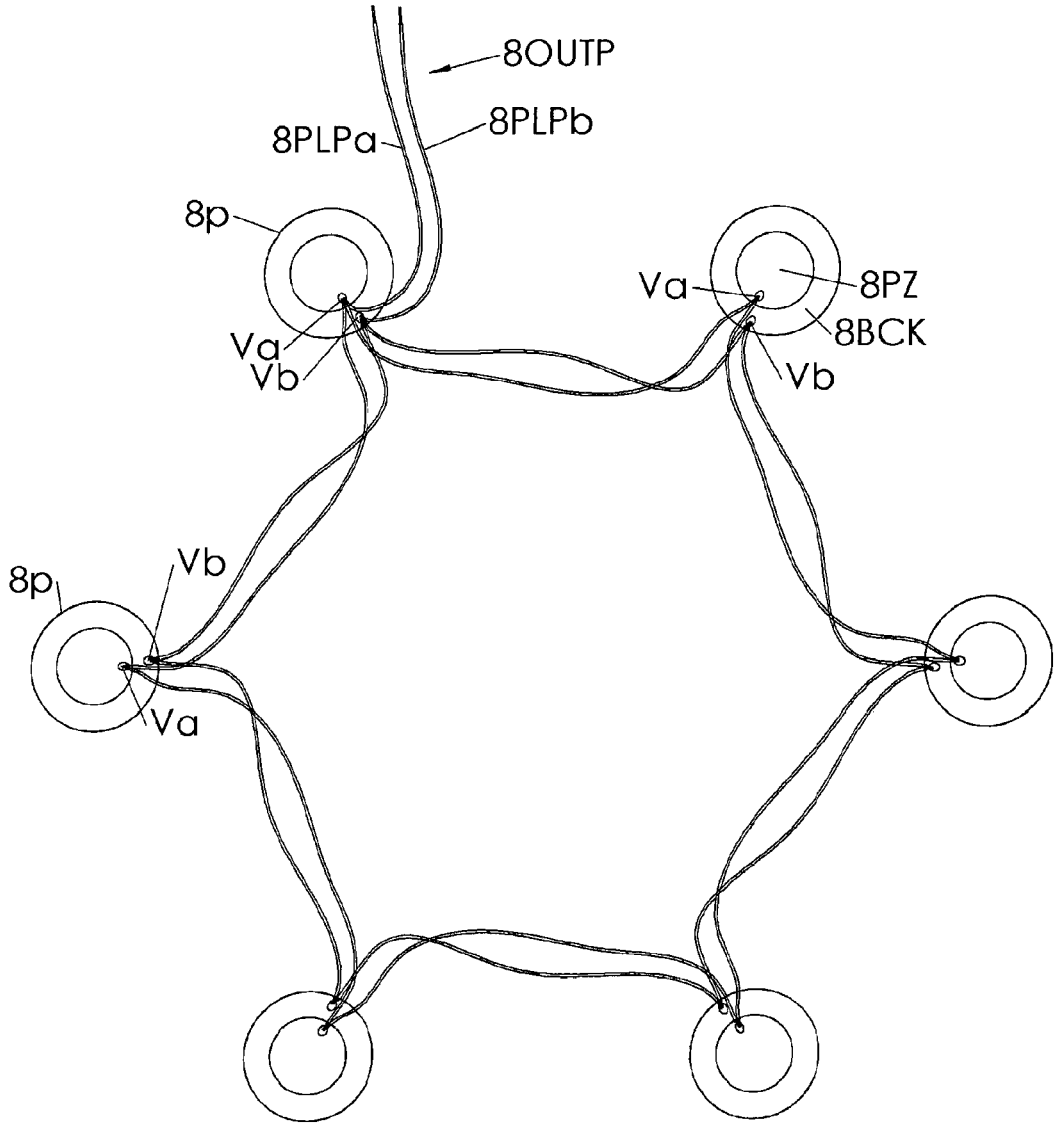
FIG. 21 illustrates the plurality of peripheral sensors coupled in electrical parallel communication.

FIG. 21 illustrates the plurality of sensors 8*p*, all coupled in parallel electrical communication. Generally, a sensor 8 may have two electrically conductive signal output leads, namely a signal lead and a ground lead. The signal lead is electrically connected to the active piezo-electric material 8PZ and the ground lead is connected to the disc 8BCK, which supports the active piezo-electric material. By being coupled in parallel electrical communication, the number of signal output leads of all the peripheral sensors 8*p* is minimized to only two such leads, namely one single peripheral signal lead and one single peripheral ground lead, which could have been indicated as 8PSL and 8GR according to their polarity.

In other words, each one sensor out of the plurality of peripheral sensors 8*p* has a first sensor lead Va and a second sensor lead Vb. The first sensor lead Va and the second sensor lead Vb of each one of the peripheral sensors 8*p* may be coupled in electrical communication to form, respectively, a common first lead, or first plurality lead 8Pla, and a common second lead, or second plurality lead 8PLb, such that the peripheral sensors are coupled in parallel electrical coupling terminating as two peripheral output leads 8OUTP to communicate a peripheral stroke output signal OUTP. This means that a single electrical output signal derived from the plurality of sensors is communicated via the common first lead and the common second lead. Since the designations of the first sensor lead Va and of the second sensor lead Vb are interchangeable, an opposite connection is possible, yielding inverse polarity.

Coupling of the first plurality and the second plurality of electrical leads in parallel provides a common electrical output signal OUTP having an excellent signal to noise ratio.

To further minimize the number of electrical conducting leads, the ground lead of the peripheral sensors 8*p* may be common with the ground lead of the center sensor 8*c*, to form one common ground lead, not shown in the Figs. This means that the ground lead of the peripheral sensors 8*p* is coupled in electric communication with the ground lead of the center sensor 8*c*. The total number of electrical leads coupled to the connector 6 of the electronic percussion device eD is thus limited to only three leads. The first lead is the single peripheral signal lead common to all the peripheral sensors 8*p*. The second lead is the lead of the center sensor 8*c*, and the third lead is the common ground lead, common to both the ground lead 8PGR of the peripheral sensors 8*p* and to the ground lead 8GR of center sensor 8*c*.

The signal conducting lead 8PSL, not shown, of the peripheral sensors 8*p* and of the signal conducting lead 8SL, not shown, of the center sensor 8*c* may be coupled to a female electrical connector 6, such as a standard ¼" TRS connector for example, as shown in FIG. 1. The connector 6 may thus provide three electrical leads, which provide two electrical signal outputs, namely outputs OUTP and OUTC, shown in FIG. 20, of respectively, the peripheral sensors 8*p* output and the center sensor 8*c* output, which are both relative to one common ground signal. The connector 6 protrudes out of the exterior 10EX of the drum shell 10 via the drum shell bore 10BR. In turn, the female electrical connector 6 may be coupled to the signal processing unit SPU via an appropriately mating cable and a similar connector 6 disposed in the SPU, not shown in the Figs.

Reference is now made to FIGS. 3A, 3B, 3C, and 3D.

FIG. 3A is substantially a diametrical cross-section of the electronic percussion device eD. The sensors support 1 is shown to have a hooked support flange 1S that is solidly retained to the shell upper edge 10R of the drum shell 10, and a platform 1P whereon the plurality of peripheral sensors 8*p* that support the vibration carrier 2 are disposed.

Figure 7:
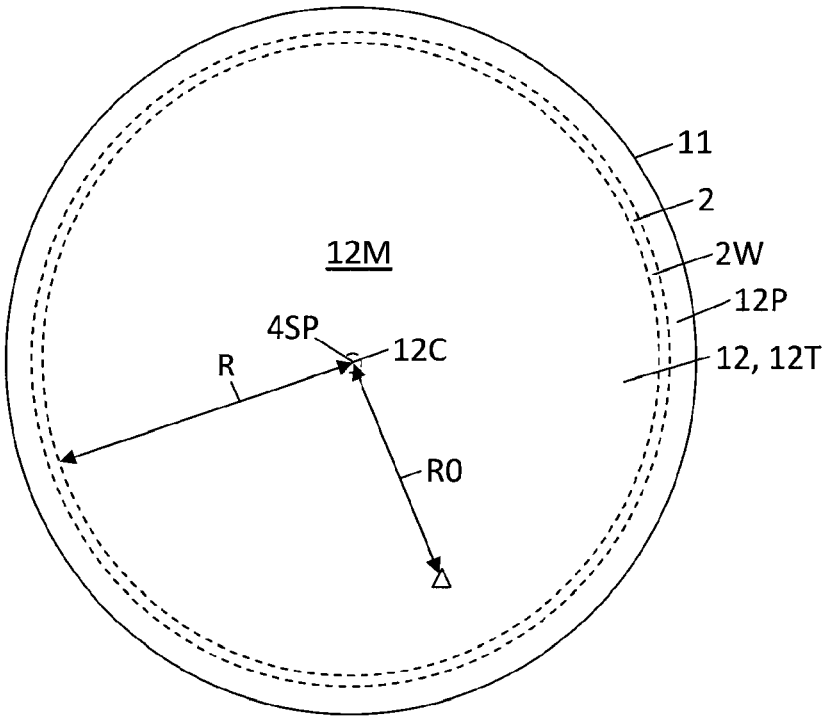
FIG. 7 is a top view of the electronic percussion device showing how the peripheral carrier divides the striking surface into two portions.

The peripheral vibration carrier 2 is a rigid body that may be made from solid homogenous isotropic material, and may be disposed concentrically into the cylindrical sensors support 1. The peripheral carrier 2 includes, for example, a carrier top edge 2T biased by and abutting in firm contact against the bottom surface 12B of the striking surface 12. Even though being biased by the drumhead 12, the peripheral carrier 2, which is disposed on top of the peripheral sensors 8*p*, may be mounted in a configuration allowing vibration, or at least one degree of freedom of motion. As best seen in FIG. 7 as a top view of the electronic percussion device eD, the peripheral carrier 2, shown in dashed lines, may be regarded as dividing the striking surface 12 into two portions. One portion is a striking surface peripheral portion 12P, which is the annular portion spanning between the rim 11 and the peripheral carrier 2, and another portion is a circular striking surface main portion 12M having a drumhead center 12C, thus extending from the drumhead center 12C to the peripheral carrier 2.

The drumhead 12 is stretched taut over the hooked support flange 1S, biases the peripheral carrier 2 in abutment against the carrier top edge 2T, and over the central vibration carrier 4. Thereby, vibrations generated in the striking surface 12 are communicated to the peripheral sensors 8*p* via the solid material of the rigid peripheral carrier 2 and also via the central carrier 4. Still in FIG. 3A, the mounting plate 5, which may be of general circular shape, is shown coupled to the bottom support 1B of the sensor base 1. The mounting plate 5 may have other structural configurations, such as for example, a beam crossing the diameter of the bottom portion of the sensors support 1B. According to desire, the mounting plate 5 may be fixedly and rigidly coupled, or rigidly but releasably coupled, or coupled via vibration isolators VIB, to the bottom portion of the sensors support 1B.

FIG. 3B illustrates an exemplary assembly of a vibrations isolator VIB for coupling the mounting plate 5 to the bottom portion of the sensors support 1B. A plurality of vibration isolating couplings VIB may be disposed in equally spaced distribution, or in other selected distributions, along the plate circumference 5P of the mounting plate 5, which may hold for example, six vibration isolating couplings.

A vibrations isolator VIB may include for example a bushing 15, a bolt 16, and an isolating grommet 14. As shown in FIG. 3B, each grommet 14 may be introduced into a corresponding grommet bore 5G appropriately disposed on the periphery 5P of the mounting plate 5. Preferably, the grommets 14 may be made of resilient material such as rubber or other elastomeric material suitable to provide vibration isolation. The grommets 14 may have a circumferential groove configured to receive therein the thickness of the mounting plate 5. Each bolt 16 may be introduced into and through the grommet 15 and coupled to a bore 1H disposed in the bottom portion 1B of the sensors support 1, which bore may have a female screw thread matching the male screw thread of the bolt 16. The grommets 14 thereby couple to and isolate the mounting plate 5 from direct solid contact with the sensors support 1 and prevent, or at least mitigate, the communication of vibrations from the sensors support to the mounting plate.

If desired, a bushing 15 may be introduced into the grommet 14 to surround the bolt 16. Evidently, other vibrations communication isolating assembly modes may be used for coupling the mounting plate 5 to the sensors support 1. Thereby, when isolation is provided, the center sensor 8*c* detects only vibrations emanating from the center 12C of striking surface 12. However, in different configurations, the mounting plate 5 may be coupled in direct solid contact with the sensors support 1.

The peripheral carrier bottom edge 2B may be freely supported or may be firmly assembled to all of the surface of the peripheral sensors 8*p*, or only onto a predetermined portion of each one of the peripheral sensors, as shown in FIGS. 3A and 3D. In general, a sensor 8 has a sensor surface 8S.

The peripheral carrier bottom edge 2B has a selected footprint surface 2FT configured to be supported by a sensor surface of each one of the peripheral sensors 8*p* disposed thereunder. The electrical stroke output signal from each one of the peripheral sensors 8*p* may be proportional to the selected footprint surface 2FT relative to the sensor surface 8S of the peripheral sensor. The same is true for the center sensor 8*c*, as shown in FIG. 3C, for the footprint surface 4FT.

As a result, the analog electrical stroke output signal from each one of the peripheral sensors 8*p* is proportional to the predetermined portion of the peripheral sensor that is in contact with the peripheral carrier bottom edge 2B. The same is true for the center sensor 8*c*.

The sensors 8*p* and 8*c* may be selected as piezo-electric sensors, or as any other suitable sensors. Coupling of the center sensor 8*c* to the mounting plate 5 is illustrated in FIG. 3C, while coupling of a peripheral sensor 8*p* to the sensor support 1 is depicted in FIG. 3D. Details of the center sensor 8*c* are also shown in FIGS. 5A and 5B.

Figure 5B:
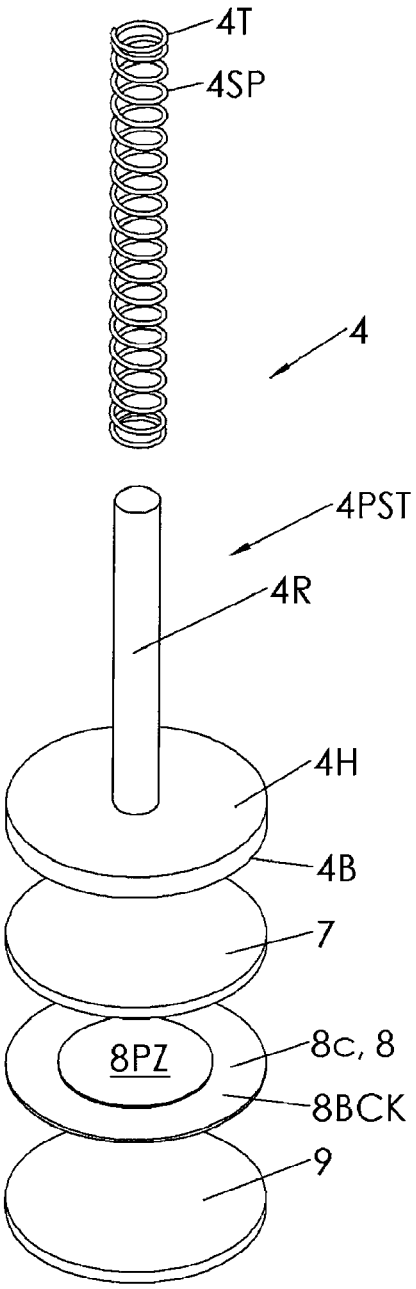
FIGS. 5A and 5B depict respectively, a sensor assembled to a central vibration carrier and an exploded view thereof.
Figure 5A:
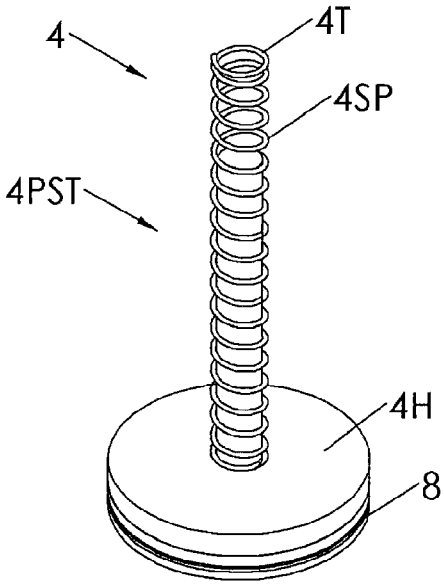

FIG. 5A depicts a sensor 8 assembled to a central vibration carrier 4, and FIG. 5B shows an exploded view of FIG. 5A. As shown in FIG. 5B, the sensor 8 has a circular portion made of piezo-electric material 8PZ that is supported by a sensor backup 8BCK, typically a thin brass disc. The sensor 8 may be sandwiched between two possibly same, say circular pieces or patches of two-sided adhesive tape, indicated as carrier patch 7 and as support patch 9. The carrier patch 7 may couple the bottom of the sensor backup 8BCK to the mounting plate 5 while the support patch 9 may couple the piezo-electric material 8PZ to the central vibration carrier 4. If desired, the carrier patch 7 and the support patch 9 may be replaced by a washer made of solid material that is glued or otherwise retained in place. However, the carrier patch 7 and the support patch 9 may be made out of flexible and resilient material that allow movement of the peripheral vibration carrier 2.

It is noted that the central and peripheral sensors, respectively 8*c* and 8*p*, may use the same piezo-electric sensor 8, and that other fastening modes of a sensor 8 to the sensors support 1 and to the vibration communication carriers VCC may also be practical.

With reference to FIGS. 5A and 5B, the central vibration carrier 4 may be configured as an assembly having a mechanical spring including at least one resilient element, such as a helical coil spring 4SP for example, which is mounted on and supported by a piston 4PST. The piston 4PST has a piston head 4H that may be circular or not, and is fixedly attached to a piston rod 4R onto which the helical coil spring 4SP is mounted. As shown in FIG. 5A, the length of the helical coil spring 4SP is longer than the length of the piston rod 4R. One end of the helical coil spring 4SP, such as the helical coil spring bottom 4B, abuts against the piston head 4H, while the other end thereof is an unsupported free end 4T, which is the central carrier top 4T, extending away from the free end of the piston rod 4R to abut against the drumhead bottom 12B, or to be biased by the drumhead bottom. The helical coil spring 4SP and the piston 4PST may be made out of the same or different solid material, for example a homogenous isotropic material, such as metal, plastic, or any other appropriate material. It is understood that other resilient elements, including various spring configurations, such as leaf springs and torsion spring may also be used for the realization of a central vibration carrier 4.

In other words, a central sensor 8*c* may be disposed on the sensors support 1, and a central carrier 4 disposed on the sensors support may comprise a mechanical spring 4SP having a first end 4B and a second end 4T, the spring first end being coupled to the central sensor 8*c* and the spring second end is biased against the drumhead bottom surface 12B.

One may say that the electronic percussion device eD comprises a drum shell 10 having a top opening 10T, and a drumhead 12 having a bottom surface facing opposite the striking surface 12T. The drumhead 12 is disposed in tension across the top opening to 10T for receiving thereon a percussion stroke that induces vibrations in the drumhead. A first means 2 may be configured as a rigid body made of solid material for receiving and transmitting vibrations from the drumhead 12, with the first means abutting against the bottom surface 12B in a plurality of locations, and a second means 8 may be configured for receiving vibrations from the first means and for generating an electrical analog signal in response to vibrations. When the first means 2 is disposed on top of the second means 8, a vibration induced on the drumhead 12 is communicated from the plurality of locations to produce a single electrical signal.

The plurality of locations at which the drumhead 12 abuts against the first means 2 may be selected to be sufficiently close to the drum shell 10 to avoid a percussion stroke directly over the first means. If desired, the first means 2 may have a top edge 2T in the shape of an annulus, which abuts against the drumhead bottom surface 12B. The second means may include a plurality of sensors where each sensor out of the plurality of sensors has a first lead and a second lead. The first leads of the plurality of sensors may be electrically coupled to form a common first lead, and the second leads of the plurality of sensors may be electrically coupled to form a common second lead, such that a single electrical output signal is derived from the plurality of sensors and is communicated via the common first lead and the common second lead.

The central vibration carrier 4 may be made as one unitary single piece of material and may be configured in various embodiments. For example, the helical coil spring bottom 4B may be supported in direct contact on top of the central sensor 8*c*, and the free end 4T thereof may abut against the bottom surface 12B of the drumhead 12. If desired, the coil spring bottom 4B may be glued or otherwise attached to the central sensor 8*c*, while the bottom surface 12B biases the helical coil spring 4SP against the central sensor. In another embodiment, not shown in the Figs., the vibration carrier 4 may be configured as a leaf spring, such as for example, in the shape of a letter "S" or "C". Again, the top of the leaf spring abuts against the center 12C at the bottom surface 12B and the bottom of the leaf spring is supported by the central sensor 8*c*, which may be disposed away from below the center of the striking surface 12C.

Figure 9:
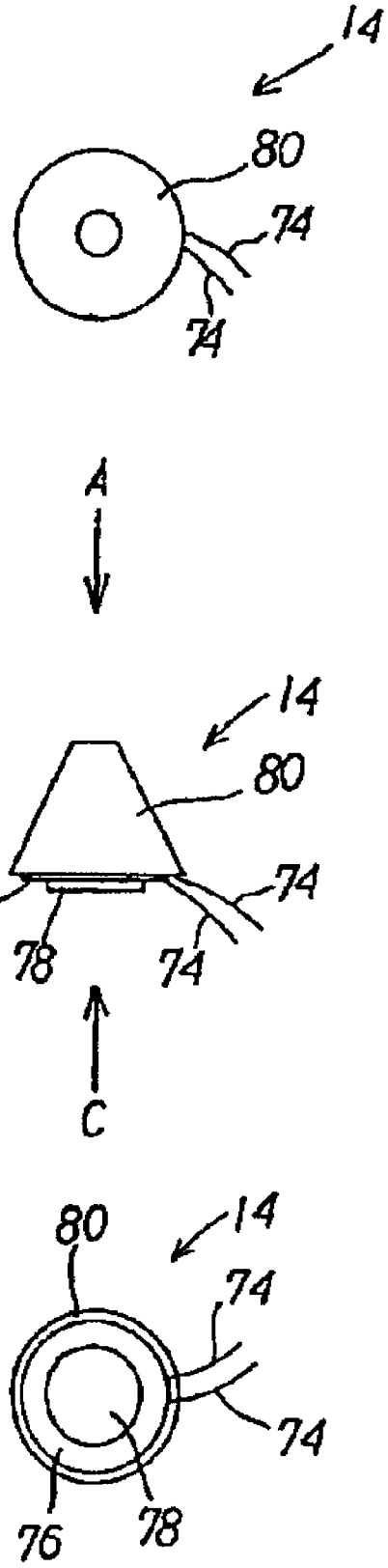
FIG. 9 RELATED ART
FIG. 9 depicts a cushioning member divulged by the related art.

Reference is made again to FIG. 3A showing the central vibration carrier 4 and the center sensor 8*c* as disposed in the electronic percussion device eD, where the center sensor 8*c* is coupled to the mounting plate 5 and the free end of the helical coil spring 4SP biases the bottom portion 12B of the drumhead 12. Vibrations of the striking surface 12T may thus be communicated to the center sensor 8*c* via solid material, i.e. via the helical coil spring 4SP and the piston 4PST. It is noted that the center sensor 8*c* may be coupled to the piston head 3H and to the mounting plate 5 in direct vibration communication assembly, say by use of mechanical fastening means, without an intermediary such as two double sided patches of tape, namely a carrier patch 7 and a support patch 9. The advantages of using a vibration carrier 4 made of solid material in contrast to employing a cushioning member as recited in the related art and shown in FIG. 9, are described hereinbelow.

There is thus disposed in the drum shell 10 a central sensor 8*c* that is configured to generate an electrical signal in response to vibration. A third means 4 abutting against the bottom surface 12B may be configured for communicating vibrations received from a center of the drumhead 12C to the central sensor 8*c* via solid material, where the third means is supported on top of and by the central sensor. The third means 4 may comprise a mechanical coil spring 4SP which abuts against the drumhead bottom surface 12B.

Reference is now made to FIG. 3D.

FIG. 3D illustrates the coupling in vibration isolation of a peripheral sensor 8*p* to the peripheral vibration carrier 2 and to the sensor base 1.

In FIG. 3D, the peripheral sensor 8*p* is shown sandwiched between a first patch of two-sided adhesive tape 9, or carrier tape 9, coupling the sensor 8*p* to the sensor base 1 and a second patch of two-sided adhesive tape 7, or support tape 7, coupling the sensor to the peripheral carrier 2. Accordingly, the carrier bottom edge 2B of the peripheral carrier 2 is supported by the peripheral sensors 8*p* above and on top thereof. The size of the area of the carrier bottom edge 2B that is in direct contact with the top of the support tapes 9 determines the extent to which the peripheral carrier 2 is able to vibrate, which vibration ability is proportional to the stroke output signal OUTP level. As shown in FIG. 3D, the footprint 2FT of the carrier bottom edge 2B is about 50% of the sensor surface 8S, however lower percentage of footprint are possible. Evidently, the size of the footprint of a vibration communication chain VCC may be selected as desired, for both the central carried 4 and the peripheral carrier 2. It is also noted that if desired, the at least one peripheral sensor 8*p* may be coupled in direct vibration communication through solid material to one or to both of the sensor base 1 and the peripheral carrier 2, for example by use of mechanical fastening means.

Figure 22:
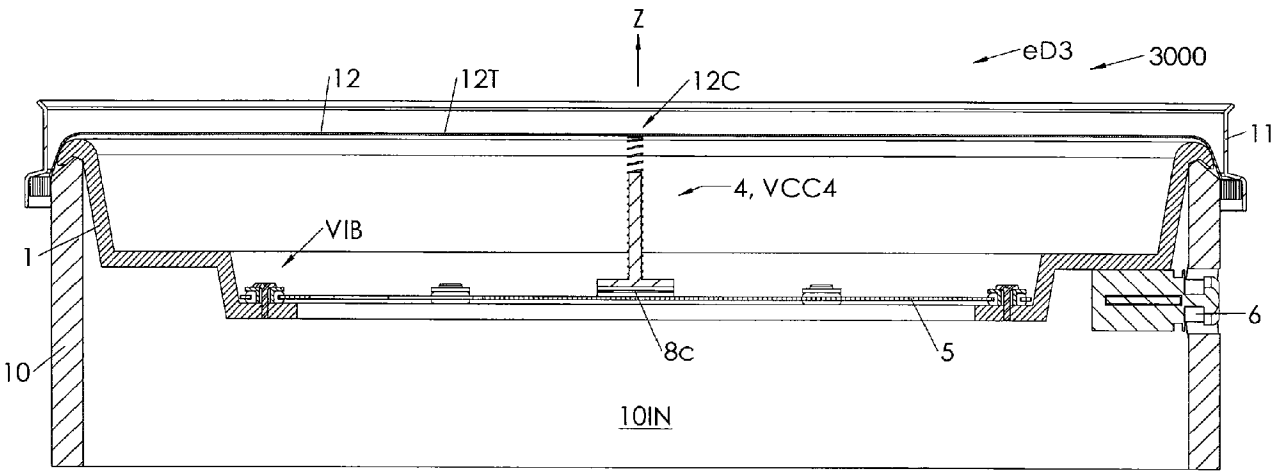
FIGS. 22 to 25 depict various optional embodiments.

The description hereinabove related to FIGS. 1-3D refers to an embodiment 1000, which includes a mounting plate 5, one center sensor 8*c* and a plurality of peripheral sensors 8*p* operative with, respectively, a first and a second vibration communication chain VCC, namely VCC 2 and VCC 4. The single center sensor 8*c* is coupled to a central vibration carrier 4, and the plurality of peripheral sensors 8*p* are coupled to the peripheral carrier 2. However, without addition to the description, one may consider another embodiment 2000 having only one vibration communication chain VCC4, similar to the embodiment 1000, but without the mounting plate 5, thus without the center sensor 8*c* and without the central vibration carrier 4, as partially shown in FIG. 17, and in FIG. 18. In addition, one may further consider yet another embodiment 3000 also with only one vibration communication chain VCC2, similar to the embodiment 1000, but without the peripheral carrier 2 and without the peripheral sensors 8*p*, as shown in FIG. 22.

A variety of embodiment are practical, examples of which are described hereinbelow and shown in FIGS. 23-25.

Figure 23:
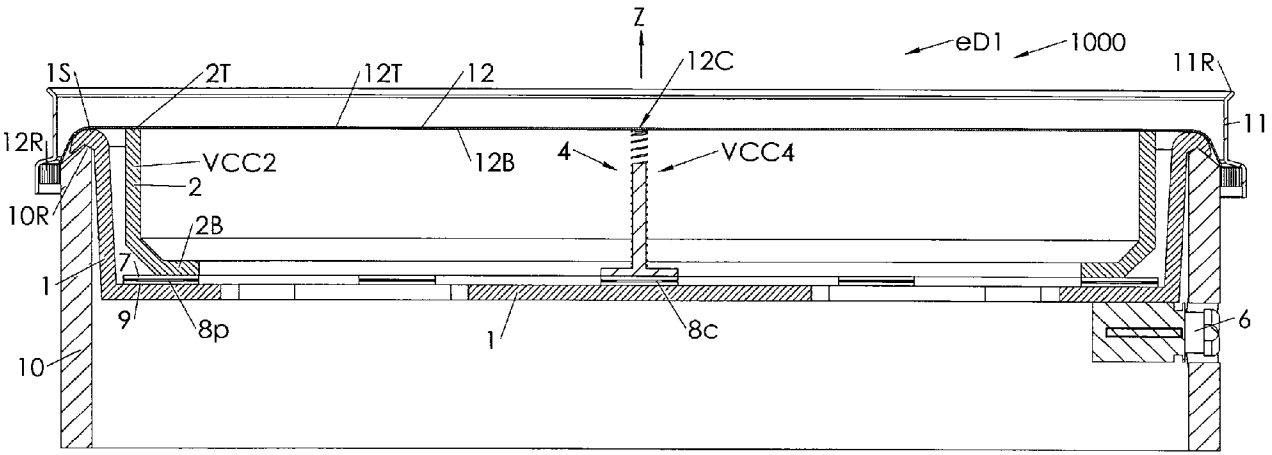

FIG. 23 is a variation of the embodiment 1000, showing a different structure where the shell interior 10IN includes a sensor support 1 supporting peripheral sensors 8*p* and a center sensor 8*c*, a vibration communication chain VCC2 or peripheral carrier vibration 2, and a vibration communication chain VCC 4 or central vibration carrier 4, in addition to the plug 6. The structural details are the same as described hereinabove with respect to embodiment 1000, but without the mounting plate 5.

Figure 24:
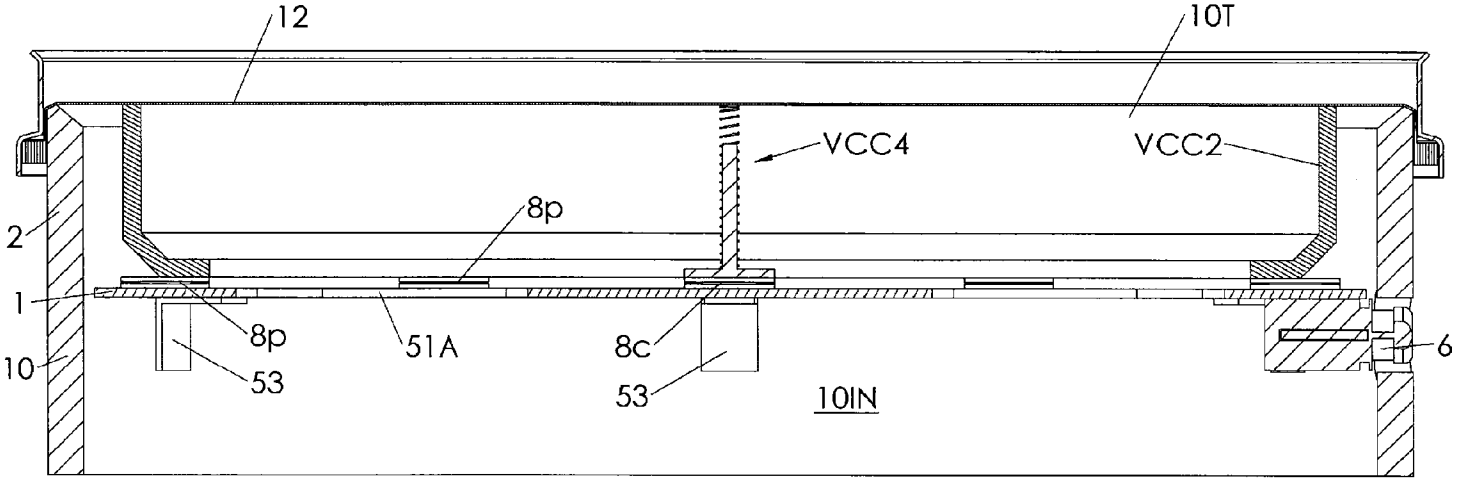
Figure 25:
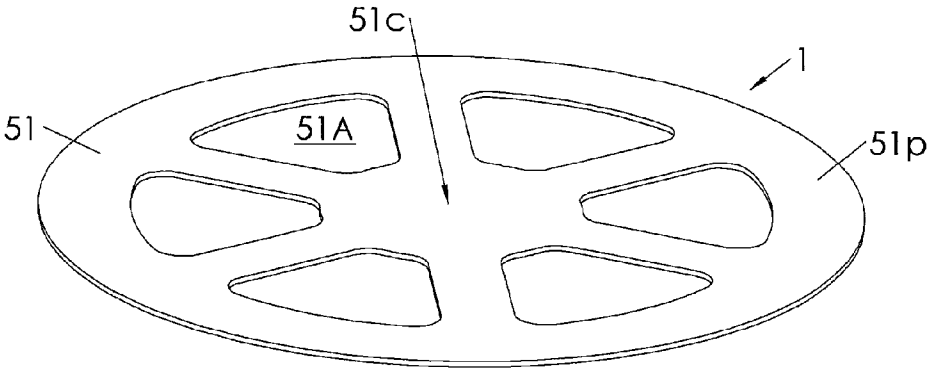

FIGS. 24 and 25 show an embodiment similar to the embodiment 1000 but with a sensor support 1 of different structure, as shown in FIG. 25. The sensors support 1 of embodiment 1000 is shown in FIGS. 24 and 25 to be configured for example as a flat sensors support plate 51 having apertures 51A for the passage of air. The flat plate 51 is fixedly coupled in the interior 10IN of the drum shell 10 by means known in the art, such as by use of brackets 53 for example. At least one sensor or a plurality of sensors 8 are distributed on the sensors support plate 51, along the periphery 51*p* and a central sensor 8*c* is disposed in the sensors support center 51*c*.

The vibration carrier 2, which forms the vibration carrier chain VCC2, may be supported on top of one or more peripheral sensors 8*p*. For stable support in the case of one single peripheral sensors 8*p*, one or more studs operating as dummy sensors support may be added to ensure the stability of the vibration carrier 2.A dummy sensor is for example an inert body having the same dimensions as a peripheral sensors 8*p*.

In FIG. 24, the drumhead 12, which is stretched over the top opening 10T, biases the vibration carrier 2, which is supported against at least one peripheral sensor 8*p* but is retained in place in a configuration that allows vibration and motion of the vibration carrier 2 in at least one degree of freedom.

The description hereinbelow refers mainly to the structure of the embodiment 1000 even though the alternative embodiments are applicable and practical too.

Figure 4:
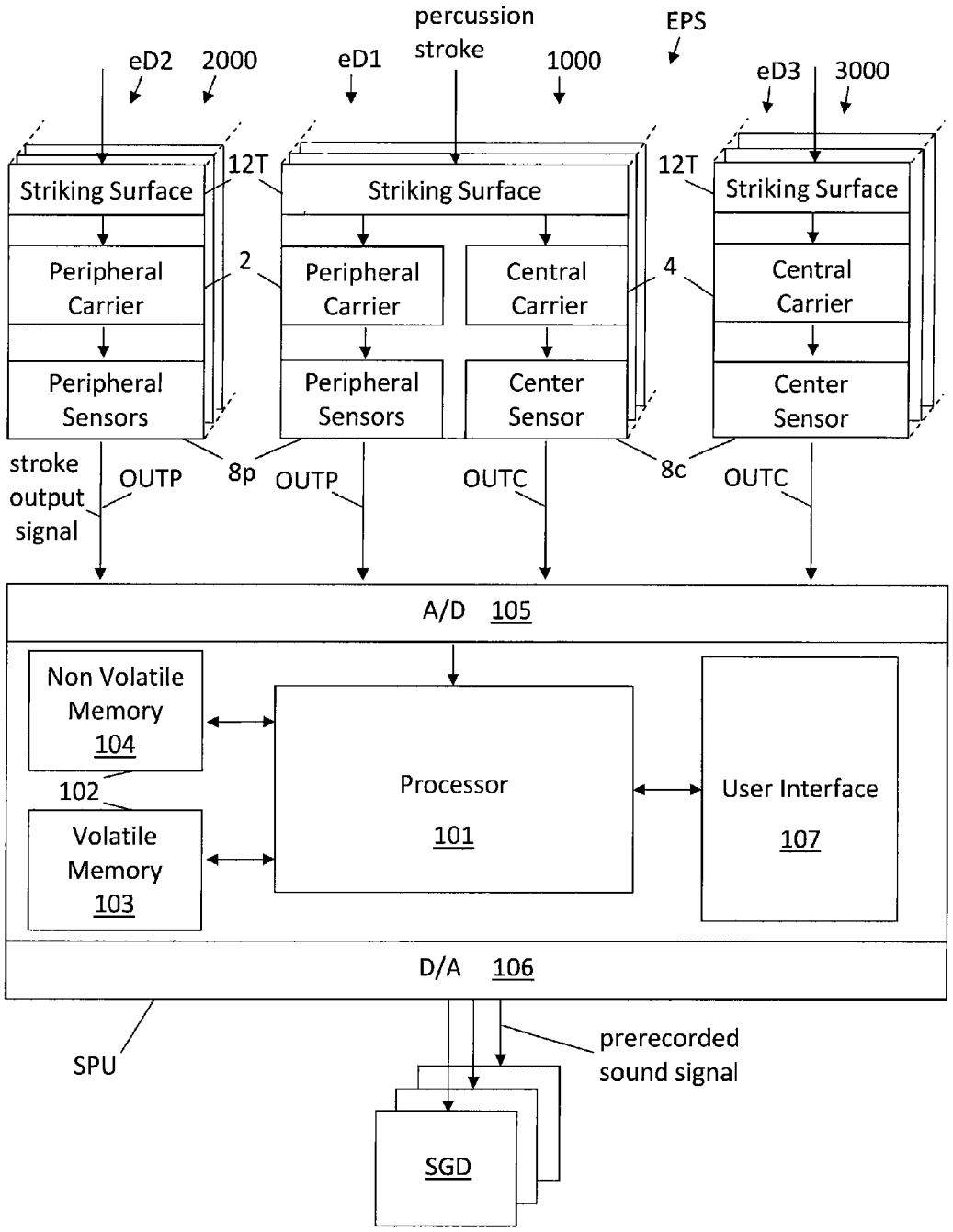
FIG. 4 illustrates a schematic representation of an exemplary electronic percussion system.

Reference is now made to FIG. 4, which illustrates a schematic representation of an exemplary electronic percussion system EPS which has a plurality of electronic percussion devices eD of various embodiments, such as for example the electronic percussion devices eD1, eD2 and eD3, and so on. However, the electronic percussion system EPS may also be operated with just one single electronic percussion device eD or with more than one electronic percussion device eD of the same or of different embodiment.

FIG. 4 shows three different embodiments of the present invention, namely the embodiment 1000 having at least one peripheral sensor 8*p* and a center sensor 8*c*, embodiment 2000 with only peripheral sensors 8*p*, and embodiment 3000 including only the center sensor 8*c*. The embodiments 1000, 2000, and 3000 are marked respectively as eD1, eD2, and eD3. An electronic percussion device eD is always coupled to the signal processing unit SPU, the output of which is coupled to a sound-generating device SGD, i.e. speaker(s), headphone(s), or a sound system.

In FIG. 4, the electronic percussion device eD1 receives the percussion strokes delivered by a user, not shown. The vibrations generated on the striking surface 12 are communicated by the peripheral vibration communication chain VCC2, here the peripheral carrier 2, and by the central vibration communication chain VCC4, here the central carrier 4, to respectively, the plurality of peripheral sensors 8*p* and the center sensor 8*c*. In turn, the sensors 8 act as vibrations transducers that deliver analog electrical stroke output signals, which are fed for output via the connector 6, not shown, to provide input to the signal processing unit SPU.

The electronic percussion device eD2 is shown in FIG. 4 to be the same as the first electronic percussion device eD1, but without the central vibration carrier 4 and without the center sensor 8*c*. Vibrations from input strokes are communicated by the peripheral vibration carrier 2 to the plurality of peripheral sensors 8*p*, which deliver stroke output signals that are fed for output via the connector 6 and for further input to the signal processing unit SPU.

The electronic percussion device eD3 is shown in FIG. 4 to be the same as the first electronic percussion device eD 1, but without the peripheral vibration carrier 2 and without the peripheral sensors 8*p*. Vibrations from input strokes are communicated by the central vibration carrier 4 to the center sensor 8*c*, which deliver stroke output signals that are fed for output via the connector 6 and further for input to the signal processing unit SPU.

The electronic percussion device eD1 outputs two different stroke output signals to the signal processing unit SPU: one signal from the peripheral sensors 8*p* and one signal from the center sensor 8*c*, which output signals are referred to as, respectively, the peripheral output OUTP and the central output OUTC. Similarly, the electronic percussion device eD2 outputs, to the signal processing unit SPU, just a peripheral output signal OUTP. Likewise, the electronic percussion device eD3 outputs only a central output OUTC to the signal processing unit SPU.

Still in FIG. 4, the signal-processing unit SPU is shown to include an analog-to-digital converter 105, a processor 101, a memory 102 including a volatile memory 103 and a non-volatile memory 104, a user interface 107, and a digital-to-analog converter 106, or D/A 106. The output of the D/A 106 is the output of the signal processing unit SPU, which outputs prerecorded sound signals, and is the input to at least one sound generating device SGD.

Although not shown the Figs., the signal-processing unit SPU may also include several connectors, which may be the same as the connector 6 of the percussion devices eD, for receiving stroke output signals from the percussion devices eD, and for outputting sound signals to the sound generating devices SGD.

With reference to FIG. 4, the processor 101 is capable of running at least one computer program, which includes a set of instructions, and is stored in a processor-readable medium, such as a memory 102. The at least one program imparts functionality to the electronic percussion device eD by being encoded in a memory 102 that is a processor-readable medium. Playing the electronic percussion systems EPS includes running a processor-driven procedure where the processor executes the instructions set forth in the at least one computer program. If desired, the signal-processing unit SPU may be configured for coupling to a desktop computer, a laptop, or any suitable processor driven device.

The memory 102 is configured to store at least one processor readable and executable program. Prerecorded sound signals may be stored in the non-volatile memory 104, and thereafter, prior to their output, may be temporarily stored in a volatile memory 103, where additional processing may be applied to the sound signals.

Even though not shown in the Figs., the user interface 107 may have a display, buttons, knobs, switches, keys and the like, that allow a percussionist to adjust and control the performance of the plurality of electronic percussion devices eD as well as that of the entire electronic percussion systems EPS.

Adjustment and control of the electronic percussion devices eD are achieved by use of a dedicated program procedures running on the processor 101 of the signal processing unit SPU. The processor 101 may have two modes of operation: The first mode is the normal play mode for input stroke detection and sound reproduction, and the second mode is a calibration mode that adjusts stroke detection parameters in association with the processor algorithms running in the first mode. The calibration mode is run in fairly rare instances, usually only upon addition of a new percussion device eD to the system EPS, and further only once in a while, to ensure that the electronic percussion system EPS is well calibrated.

In operation, the analog stroke output signals received by the signal processing unit SPU via appropriate connectors are sampled by the analog-to-digital converter 105, or A/D 105, and forwarded to the processor 101. Then, the processor 101 runs the program(s) described in detail hereinbelow, in search for user provided percussion input strokes. In turn, the processor 101 analyzes the input data received as stroke output signals via the A/D 105 and outputs prerecorded sound signals to the digital-to-analog converter 106, or D/A 106. Finally, the prerecorded sound signals are communicated to the percussionist by means, for example, of a loudspeaker or of headphones, shown in FIG. 4 as sound generating devices SGD.

The basic difference of the principle of operation by which a vibration generated in the striking surface 12 is converted into an electrical stroke output signal by the single center sensor 8*c* versus the plurality of peripheral sensors 8*p* is now described.

Figure 8A:
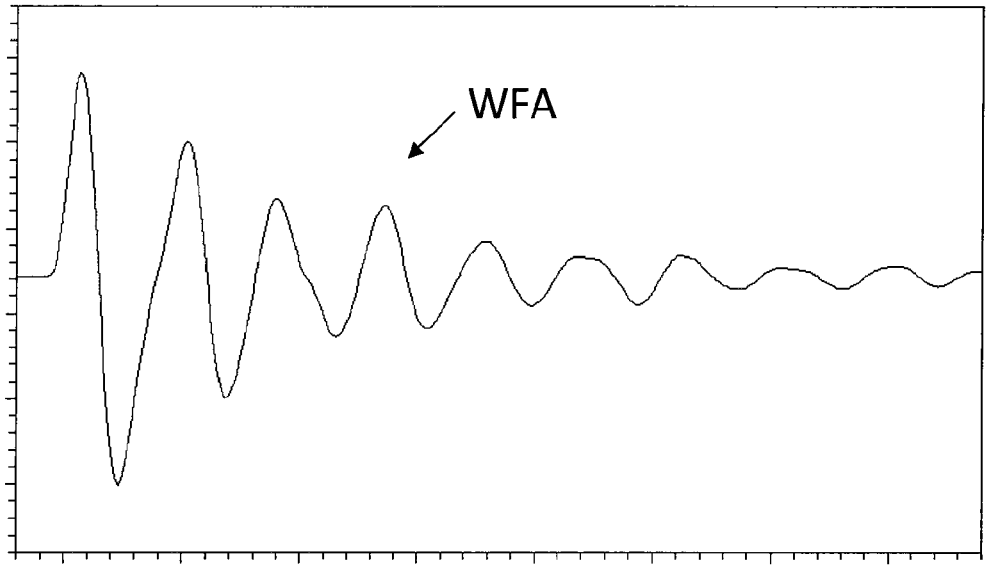
FIGS. 8A and 8B show a typical vibration wave captured in response to a drumhead stroke by, respectively a plurality of peripheral sensors, and a single piezoelectric sensor as disclosed by the related art.
Figure 8B:
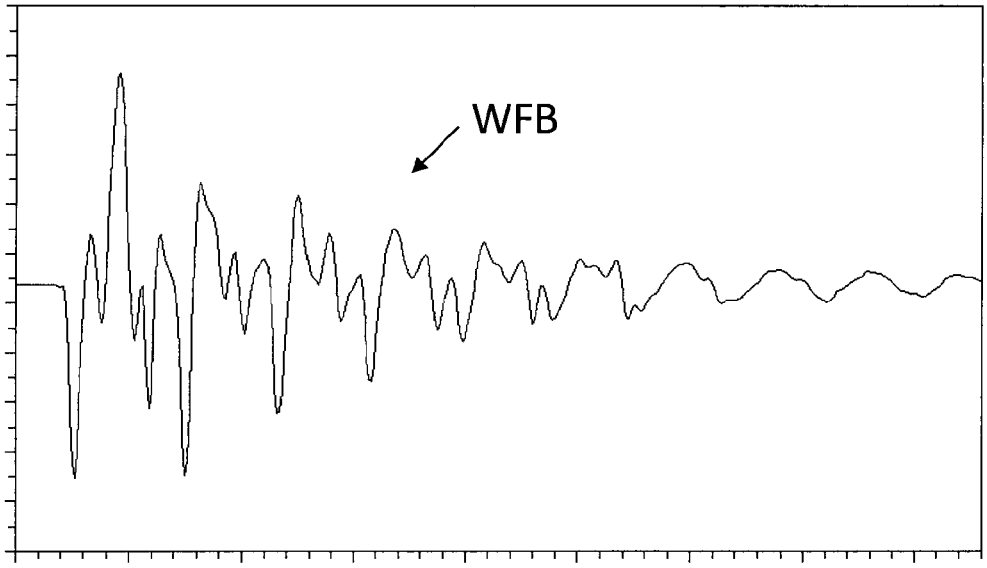

FIG. 8B is a diagram of a typical vibration waveform WFB of a stroke output signal, as may be captured in response to a drumhead stroke by a single piezoelectric sensor 8 that is coupled to a frusto-conical cushioning member 80, such as disclosed in the related art and shown in FIG. 9. The shape of the stroke output signal received via the cushioning member 80, as seen in FIG. 8B, presents several harmonies and as a consequence, is extremely difficult to analyze in real time. Moreover, the diagram of the stroke output signal is highly non-deterministic since the shape and frequency content thereof vary significantly according to the intensity of the stroke on the drumhead, according to the location of the stroke on the drumhead 12, and also according to the tension and the material of the drumhead.

In contrast to a stroke output signal that is received on a single sensor, such as the one described in the related art, FIG. 8A shows a typical vibration wave WFA captured by a plurality of peripheral sensors 8*p* in response to a drumhead stroke. The plurality of peripheral sensors 8*p* are all mutually coupled, first in mechanical vibration communication via the rigid vibration carrier 2 that is made out of solid material, and second, in parallel electrical connection. The shown signal WFA features many advantages over the stroke signal described by the related art. To begin with, the WFA signal is free from spurious harmonies and clearly shows only the fundamental frequency of the vibration wave, allowing for analysis and extraction of certain features, as described hereinbelow, that are necessary for an accurate detection of the location of the stroke on the drumhead 12.

The fact that the received stroke output signal WFA lacks spurious harmonies and contains only one basic harmony is a result of the use of the peripheral vibration carrier 2 that has a given mass and is a rigid body made out of solid material. First, the mass of the peripheral vibration carrier 2 implies an inherent moment of inertia, which resists displacements caused by small vibrations, but responds only to the dominant fundamental vibrations. Second, the received stroke output signal WFA is insensitive to changes in stroke location and in stroke intensity in the sense that the waveform remains of similar shape, allowing the application of computer program procedures that produce consistent and reliable results over the entire area of the striking surface 12. Third, the received stroke output signal WFA is characterized by a high signal-to-noise ratio, or SNR, since actually it is the average of the output of the plurality of peripheral sensors 8*p*, thus allowing for even the faintest strokes to be easily detected.

The introduction of the peripheral carrier 2 to convey vibrations to the peripheral sensors 8*p* also facilitates the detection of the position of a drum stroke on the two-dimensional striking surface 12 by effectively reducing the problem to a one dimensional issue. The position of a detected drum stroke is found as the radial distance measured on the striking surface 12 from the stroke point to the drumhead center 12C, regardless of the angular position of the stroke with respect to the drumhead center. Such a result is based on the fact that the peripheral vibration carrier 2 is circular and concentric, whereby circular symmetry is maintained over the angular dimension with respect to the drumhead center 12C. Concentric means centered on the same axis Z.

Furthermore, although the introduction of a limited number of peripheral sensors 8*p* may cause some degree of deviation from a perfect angular symmetry, analysis of the stroke output signal WFA does not show such a deviation. The angular symmetry property is maintained despite the limited number of peripheral sensors 8*p*. When an input stroke is received, and even when only six peripheral sensors are provided, as shown in FIG. 6, it is the peripheral vibration carrier 2 that communicates vibrations to adjacent sensors 8*p*, effectively maintaining full symmetrical behavior.

A first algorithm is now described for the first embodiment 1000, which contains two vibration communication chains, namely VCC2 and VCC4 embodied as, respectively, the peripheral vibration carrier 2 and the central vibration carrier 4. The first algorithm is dedicated to sensing input strokes impinging on the drumhead 12 and to providing the sound generation corresponding thereto. The first algorithm has four main sub-algorithms operating in mutual association to provide a sound that faithfully represents the input stroke as received. The first sub-algorithm is the position detection algorithm. The position detection algorithm detects the location of the stroke and outputs the radial distance measured on the striking surface 12, from the drumhead center 12C to the stroke location. It is noted that the distance separating the drumhead center 12C from the peripheral carrier 2 is a selected predetermined distance.

The second-sub algorithm is the stroke intensity detection algorithm. The stroke intensity detection algorithm estimates the intensity of the stroke, eliminating 'hot spots' of high intensity that are generated by strokes hitting the striking surface 12 just above and on top of a sensor 8.

The third sub-algorithm is the sound generation algorithm. The sound generation algorithm uses the detected position and intensity of the input stroke to compute a sound signal that will result in the generation of a prerecorded sound signal corresponding to the input stroke. The generated sound signal may include one or more prerecorded sound signals.

The fourth sub-algorithm is the delay minimization algorithm. The delay minimization algorithm coordinates all previous sub-algorithms in incremental steps to output a sound signal within a minimal time delay, where the time delay is measured from the moment the input stroke strikes the drumhead 12 to the moment when the sound generated by the sound generating device SGD is heard.

The operation of each one of the four sub-algorithms is described in detail hereinbelow prior to the description of the entirety of the first algorithm.

The first sub-algorithm, namely the position detection algorithm is now described in detail. Reference is made to FIG. 7, which is a top view of the striking surface 12. In FIG. 7, a ring of dashed lines represents the peripheral carrier 2, which divides the striking surface 12 into a striking surface peripheral portion 12P and a striking surface circular main portion 12M having a drumhead center 12C. It is now assumed throughout the description hereinbelow that the projection of the helicoidal spring 4SP onto the drumhead 12, shown as a dashed circle in FIG. 7, has the dimension of a geometrical point disposed at the drumhead center 12C, neglecting the actual diameter of the helicoidal spring. Furthermore, the actual thickness of the peripheral carrier 2, ranging from four to two millimeters, or even less, is considered to be negligible relative to the size of the striking surface 12, which thickness is considered to have the dimensions of a geometrical line, and may be disregarded for the purpose of computation.

The position detection algorithm allows for the computation of the radial distance from the drumhead center 12C to the location of the stroke on the main drumhead striking surface portion 12M. The computed output distance shows a continuous variation in the detected position according to respective continuous variation in the position of the input strokes entered by the user. In contrast, input strokes delivered onto the striking surface peripheral portion 12P will be detected as such but the exact position thereof within the peripheral portion 12P is not computed. It is noted that strokes hitting the peripheral portion 12P are not recommended since strokes adjacent the rigid peripheral carrier 2 will prevent proper bounce back of the drumstick and will produce noise. However, since the striking surface portion 12P is a very thin ring about half a centimeter thick in radial dimension, this is not really a limitation. Furthermore, striking the peripheral portion 12P is seldom and is not practical because of the proximity to the rim edge 11R, which rises higher up above the surface of the drumhead 12.

The following notations are now accepted with regard to the description of the operation of the position detection algorithm. The time taken by a vibration wave to travel along an arbitrary radial path across the surface of striking surface main portion 12M from the drumhead center 12C to the peripheral carrier 2 is denoted as time T. It is momentarily assumed that the time T is known and that the time T is constant regardless of the radial direction of travel of the vibration wave front. This last assumption will be followed later on by the introduction of a calibration step that will measure the time T and will tune the electronic percussion device eD to provide a substantially identical time of travel in all radial directions.

With reference to FIG. 7, let R0 denote the distance measured from the drumhead center 12C to an arbitrary percussion stroke location point, indicated as Δ, on the striking surface main portion 12M. Furthermore, let t0 be denoted as the time at which the percussion stroke hits the striking surface 12, t1 as the time at which the induced vibration wave front reaches the center sensor 8*c*, t2 as the time at which the induced vibration wave front reaches the peripheral sensors 8*p*, and R as the radius of the striking surface portion 12M. R is a predetermined distance that is controlled at the manufacturing stage. The predetermined distance R is defined as the internal radius of an annular disc formed by the surface 2W of the peripheral carrier top edge 2T, which abuts on the drumhead bottom surface 2B. The times t0, t1 and t2 are measured relative to some arbitrary moment in time, which may be, for example, the moment of initialization of the position detection algorithm. It is assumed throughout the operation of the position detection algorithm that the vibration wave front propagation time traveling in the solid material(s) from which the vibration communication chains VCC2 and VCC4 are made, is negligible when compared to the vibration wave front propagation time in the striking surface 12. This assumption was tested, turned out to be well founded, and provides a very good approximation.

It is obvious that the time t0 at which the percussion stroke hits the drumhead 12 is unknown, and that the times t1, and t2 are known since they are measured by the signal processing unit SPU. Moreover, the time T will be known following application of the calibration step to be introduced hereinbelow, and the radius R is known and set by the manufacturer of the percussion device eD. If desired, to simplify the use of the percussion instrument, the predetermined constant T may be set in factory at the manufacturing stage, or else, by the user when operating a calibration procedure. It will be shown hereinbelow that only the ratio R0/R is of importance so that the value R needs not be known and as a consequence thereof, the first algorithm is not dependent on the size of the percussion device eD.

Assuming that wave front propagation travels at constant speed, as is the case in homogeneous media, the following equations may be formalized:

$$(t1-t0)+(t2-t0)=T \qquad \text{equ. (1)}$$

$$R0=(t1-t0)*R/T \qquad \text{equ. (2)}$$

Equation (1) simply states that the summation of the times of travel from the input stroke location point to the center sensor 8*c* and from the input percussion stroke location point to the closest one out of the peripheral sensors 8*p* equals a constant T. In other words, the constant T is the overall time of propagation it takes a vibration wave front generated by a drumstick input stroke to travel from the input stroke location point to the center sensor 8*c* and up to the peripheral sensors 8*p*. It is noted that since the peripheral sensors 8*p* are connected electrically in parallel, it is sufficient for the vibration wave front to arrive only to one of the sensors 8*p* in order to be detected.

Equation (2) applies a linear ratio between the time of travel from the input stroke location point to the drumhead center 12C and the corresponding time of travel from the sensor 8*c* and up to the sensors 8*p*, assuming a constant wave front propagation speed. Solving for R0, it can be shown that:

$$R0=R*(t1-t2+T)/(2*T) \text{ or } R0/R=(T1-t2+T)/(2*T) \quad \text{equ. (3)}$$

As a quick check of equation (3), it is observed that if the input stroke is received on the striking surface 12 halfway between the sensor 8*c* and the sensors 8*p*, then t1 must be equal to t2. Substitution into equation (3) yields R0=R/2 as expected. Similarly, a check for an input percussion stroke hitting at the drumhead center 12C should provide t2=t1+T. Substituting into equation (3), R0=0 is obtained as expected.

It is reminded that the distance separating the drumhead center 12C from the peripheral carrier 2, is a selected predetermined distance.

Returning to input percussion strokes hitting the striking surface peripheral portion 12P, it is observed that under ideal conditions, where the tension is constant across the entirety of the area of the drumhead 12, the time difference (t1–t2) must be equal to T. This is true regardless of the exact location point of the stroke received on the striking surface peripheral portion 12P. This relation is sufficient to determine that the input stroke actually impacted on the striking surface portion 12P. However, the exact locations of input strokes within the striking surface peripheral portion 12P cannot be determined since the result of all the input strokes hitting therein will provide the same time difference. Under actual conditions, a drumstick input stroke in the striking surface peripheral portion 12P will result in the time difference (t1–t2) being approximately the time T. Nevertheless, if for some reason the received measured time difference (t1–t2) is greater than the time T, then the conclusion is that the electronic percussion device eD is not properly calibrated. Since the time T is a system parameter determined during calibration of the electronic percussion device eD, one may adjust the value of the time T to increase such that it will become equal to (t1–t2), or else, one may leave the time T as is, but inform the user that a calibration step is needed.

Reference is made to the calibration mode or calibration stage, the purpose of which is to determine the time T by adjustment of the tension of the drumhead 12. It is recalled that the time T is defined as the time it takes a vibration wave front to travel radially across the striking surface 12M from the drumhead center 12C to the peripheral carrier 2, and to arrive to the closest one out of the peripheral sensors 8*p*. In other words, the time T is also the time of travel from the peripheral carrier 2 to the drumhead center 12C, which is independent of the location of the input stroke in the striking surface peripheral portion 12P. Thereby a practical method is suggested for measuring the time T and for the adjustment of the tension of the drumhead 12. When entering the calibration stage, the percussionist is asked to repeatedly strike all over the drumhead peripheral portion 12P. While doing so, the signal processing unit SPU may show for each input stroke, the time T that is measured as indicated on the display of the user interface 102, which is shown in FIG. 4. The percussionist is instructed to adjust the tension of the drumhead 12 by use of the drum bolts 17 while receiving feedback from the signal processing unit SPU about the measured time T. The goal of the calibration stage is to achieve, as close as possible, identical values for the various measurements of the time T detected by striking different locations on the drumhead peripheral portion 12P. After the calibration process is finalized, the last measured time T is saved in the non-volatile memory 103.

A note is in order regarding the accuracy of the first algorithm. Equation (3) shows a linear relation between the times t1 and t2 and the resultant radial distance R0, from which it is clear that an error in the estimation of the radial distance R0 is also linear with an error in the detection of the times t1 and t2. Fortunately, the time difference (t1–t2) is not negligible and may typically last for more than 1 millisecond for a 12" electronic percussion device eD having a normally tensioned striking surface 12. In consequence, the resolution of the detection of the location of a drumstick strike is very high. Typically, for a 12" percussion device eD, such a resolution allows for the detected radial distance to be differentiated into 128 different levels, where each level corresponds to a different unique radial distance R0 output by the algorithm.

Reference is made to the fourth sub-algorithm, which is the delay minimization algorithm. As with electronic percussion instruments, the time delay is defined as the time difference between the moment at which an input stroke hits the percussion surface 12 and the moment at which an appropriate sound is generated by the sound generating device SGD shown in FIG. 4. Research carried out on human perception of sounds suggests that a delay of 2 milliseconds and above is perceivable by the ear, posing a challenge to the manufacturers of electronic percussion systems EPS. In the electronic systems disclosed in the related art, the overall time delay is a result of three main delay factors, as graphically exposed in FIG. 10A.

Figure 10A:
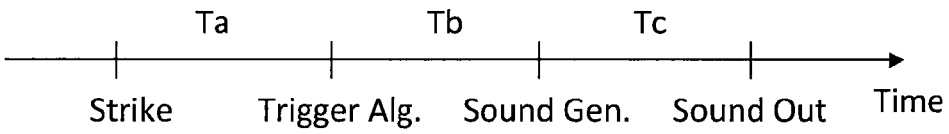
FIG. 10A Related Art
FIGS. 10A and 10B depict delay factors of, respectively, the related art and the presently claimed invention, FIGS. 11A and 11B detail a two-dimensional space where one dimension is the radial location of the detected percussion stroke and the other dimension is the stroke intensity.

FIG. 10A depicts three delay factors, namely Ta, Tb, and Tc. The first delay factor is the time Ta it takes a vibration wave front to travel across the striking surface 12M from the point of the input stroke to one of the sensors 8. In other words, the delay factor Ta is the time lasting between the moment the input stroke is received and until the sensors 8 start to receive the related wave front vibration signal. The triggering algorithm is described hereinbelow, where typically, Ta may exceed 1 millisecond for a 6" distance of travel with a normally tensioned striking surface 12 and therefore, the time delay Ta is not negligible.

The second delay factor is the time Tb lasting from the moment the vibration wave front arrives at the sensors 8 and until the first and second sub-algorithms decide that an input stroke was received and determine the stroke intensity and the stroke position. It is well known from the related art that the estimate for the input stroke intensity is simply the maximum amplitude of the received input stroke signal. Therefore, the time Tb may also be regarded as the time that elapses from the moment a new input stroke is detected by a sensor 8 until the received input stroke signal reaches its maximum level. Typically, the time Tb may exceed 1 millisecond, especially with high intensity input strokes.

The third delay factor is the time Tc that is required by the signal processing unit SPU from the moment of decision to output a sound signal, and until the moment at which an audible sound is actually emitted to the user via the sound-generating device SGD. The time Tc is essentially an electronic delay time, dependent on the performance of the processor 101 and on the design of the electronic hardware of the signal processing unit SPU, and usually, cannot be reduced to less than 0.4 milliseconds.

As a result of the description hereinabove, the time delays referred to in the related art last for more than 2 milliseconds, which exceeds the threshold of human perception, thereby causing degradation in the playing experience of electronic percussion devices eD. In the embodiments of the present invention, new specifically dedicated computer program procedures saved in memory and executed by the processor 101 are introduced for effectively eliminating the delay time Tb, while still allowing for an accurate detection of the input stroke intensity and position. The result thereof is the ability to reduce the overall time delay by at least 1 millisecond. This means that the sum of the time delays Ta, Tb, and Tc described hereinabove and shown in FIG. 10B may be shortened by one millisecond.

Figure 10B:
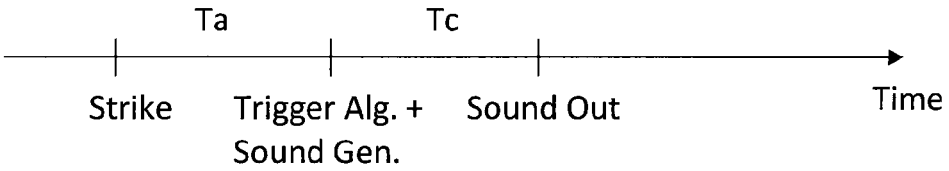

FIG. 10B illustrates that a time Ta elapses from the moment of the percussion stroke until a sensor 8 starts to receive vibrations, where the triggering algorithm works in parallel with the third sub-algorithm, which is the sound generation algorithm, to begin the output of audible sounds. Advantage is taken from the physiological characteristic fact that the human hearing perception is sharp enough to detect small delays of time when expecting to hear a sound, while being less susceptible to perceive absolute sound values during the initial rise time of the outputted sound waveform. This physiological characteristic permits some tolerance for errors in actual sound production. At the instant a sound is detected, the exact intensity of the input stroke is still not known, but nevertheless, the third sound generation sub-algorithm is called to generate an estimated sound a priori.

For the a priori generation of an estimated sound, one may simply make use, as a first scheme for deriving a conservative estimate, of the value of the input stroke intensity received so far, multiplied by some constant to account for sound volume. However, other estimation schemes may work as well. The conservative estimate is updated with each new stroke sample received by the processor 101, thereby continuously improving estimation accuracy. The estimate update process is repeated until the maximum level of the input stroke signal is detected, at which point the estimate becomes the exact value of the maximum level of the stroke signal. The completion of such an estimation update process typically takes up to 1 millisecond, the same as the time Tb shown on FIG. 10A. However, in contrast to the related art, in the embodiments of the present invention, the time interval Tb of the estimation update process does not contribute to the overall delays totaling Ta, Tb, and Tc described hereinabove with respect to FIG. 10A, since the estimation update process takes place in parallel with the sound signal generation process.

The embodiments of the present invention also provide a practical method for sound generation. As described hereinabove, a suitable sound is generated to the ear of the user while and throughout the period of time during which the features of stroke intensity and of stroke location are still being derived. However, it would be virtually impossible for the non-volatile memory 103 of the signal processing unit SPU, shown in FIG. 4, to store a sound signal for each and every location of a stroke on the striking surface 12, and for every such location to save different stroke signal intensities. It has to be considered that for example, for 128 levels of different radial locations on the striking surface 12, with each of these 128 locations having 128 different stroke signal intensities, one would need to store in memory 128*128, or 16,384 different sound signals for each percussion device eD. Evidently, it is impractical to store such a huge number of sound signals in memory, and it is also impractical to record these sound signals in the first place.

Even in case of compromise, should the striking surface 12 be divided into say only ten areas, where each area has only ten different stroke signal intensities, this would still result in a total of 100 sound signals. Even one hundred sound signals are still a problem to record and store in memory since an electronic percussion system EPS may include many electronic percussion devices eD, each of them able to switch between many different prerecorded percussion instruments, where each of these instruments contains one hundred such sound signals.

With the embodiments of the present invention, instead of relying upon a sheer number of prerecorded sound signals, a relatively small set of prerecorded sound signals is stored in the non volatile memory 103 of the signal processing unit SPU, which prerecorded sound signals are mixed together with appropriate weights during the sound signal output process.

Figure 11A:
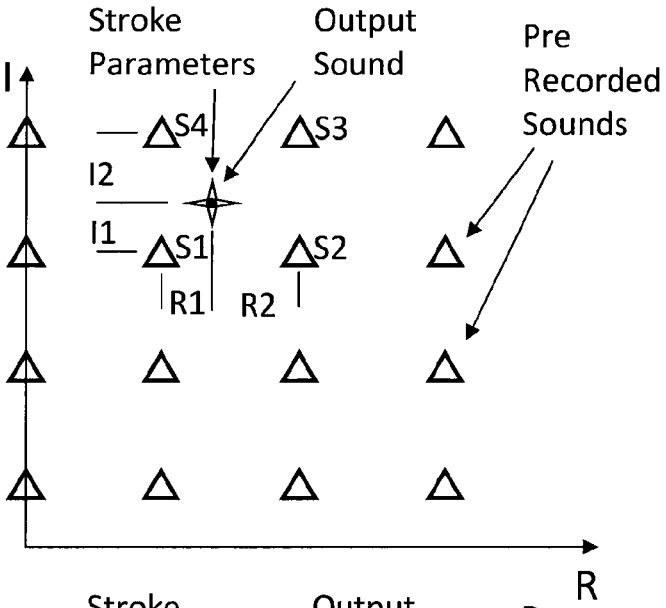
Figure 11B:
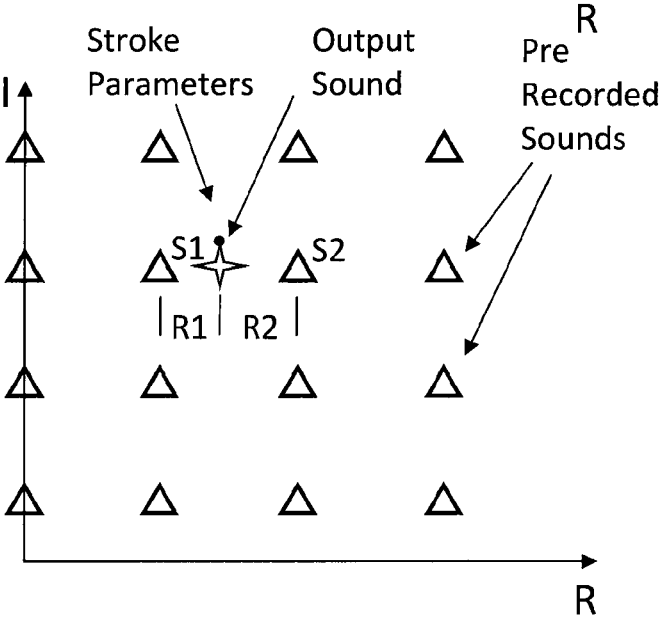

FIGS. 11A and 11B both detail a two-dimensional space where one dimension is the radial location R of the detected percussion stroke on the striking surface 12, and the other dimension is the stroke intensity I. FIGS. 11A and 11B also illustrate a typical number of prerecorded sound signals that correspond to a matrix of four stroke locations by four stroke intensities, where each such location and intensity is indicated by a triangle. When an input stroke signal is detected by the processor 101, the input stroke location and intensity parameters are derived, and, for purpose of illustration, are marked by a dot in the FIGS. 11A and 11B.

The third sub-algorithm for sound signal generation provides two options for sound dithering. One option, according to FIG. 11A, mixes four prerecorded sound signals to form a single output sound signal, while the second option, as by FIG. 11B, mixes only two prerecorded sound signals to form the output sound signal. In both cases as shown in FIGS. 11A and 11B, the output sound signal is indicated by a four-point star.

In FIG. 11A, the distances in the radial dimension R are denoted as R1 and R2, and the stroke signal intensities are denoted as I1 and I2 in the intensity dimension I, as designated intermediate the detected input stroke location and the closest prerecorded sound signals denoted as S1-S4. The proposed third sub-algorithm for sound generation uses a weighted sum of the prerecorded sound signals S1-S4 for the generation of the resulting output sound signals, where each weight is proportional to the proximity of the detected stroke location point to the corresponding prerecorded sound signal, as summarized by equation (4A):

$$\text{Output Sound}=(S1*R2*I2+S2*R1*I2+S3*R1*I1+S4*R2*I1)/((R1+R2)*(I1+I2)) \quad \text{equ. (4A)}$$

Each one of the sound signals S1 to S4 in the nominator of equation (4A) is multiplied by two linear factors that correspond to the dimension R and to the dimension I. The denominator of equation (4A) is a normalization factor controlling the intensity of the output sound signal. It is noted that equation (4A) is kept independent from units of the R and I dimensions. As a quick check, it is observed that if an input stroke is detected at the exact location of S1, then R1 and I1 are zero. After substitution into equation (4A), the resulting output sound signal is equal to S1, as expected. It is important to note that the third sub-algorithm for sound generation relies heavily on the fact that the human perception will not notice that actually four sounds are being played, but will rather perceive only one sound. Furthermore, equation (4A) ensures that the output sound signal will vary continuously in accordance with received input strokes having continuously varied radial location and intensity. In consequence, a typical number of 16 prerecorded strokes may theoretically produce an infinite number of output sound signals, limited only by the accuracy and the resolution of the detected stroke location and intensity. With the embodiments 1000 and 2000 of the present invention, the resolution of the detected input stroke location and intensity reaches 256 levels of different intensities, and 128 levels of different radial positions, the result of which is 32,768 different output sound signals. In comparison with a simple algorithm for the output of just one single sound signal, the third sub-algorithm for sound generation actually requires four times more processing performance power according to the embodiments of the present invention. Even though the scheme described in equation (4A) for sound generation is more difficult to compute, it is nevertheless possible to be realized with the digital signal processors, or DSPs, presently available on the market. However, if such processing power requirements cannot be realized, one might still prefer to use a variant of the third sub-algorithm for sound generation as depicted in FIG. 11B. Such a variant may use only two prerecorded sound signals that are mixed together with respect to the R dimension while using the nearest neighbors in the I dimension. The variant method cuts processing power requirements by half, while still allowing the output of a fairly large number of sound signals.

Referring to FIG. 11B, R1 and R2 are shown to denote the distances in the radial location dimension between the detected stroke signal and the closest prerecorded sound signals S1 and S2. The variant third sub-algorithm uses a weighted sum of S1 and S2 for the generation of the output sound signal, where each weight is proportional to the proximity of the detected location point to the corresponding prerecorded sound signal, as summarized by equation (4B):

$$\text{Output Sound}=(S1*R2+S2*R1)/((R1+R2)) \qquad \text{equ. (4B)}$$

Each one of the sound signals S1 and S2 in the nominator of equation (4B) is multiplied by a linear factor that corresponds to a distance in the R dimension. The denominator is a normalization factor controlling the intensity of the sound signal output, whereby the equation (4B) is kept independent of the units of radial distances R1 and R2.

Following is a description regarding the central vibration communication chain VCC4 including the elements of the central vibration carrier 4 as shown in FIGS. 5A and 5B, in comparison to the cushioning member 80 disclosed in the related art as depicted in FIG. 9. Generally, one function of a central vibration communication chain VCC4 is to remain in contact with the drumhead center 12C, to communicate vibrations from the drumhead 12 to an underlying center sensor 8*c*, which transforms the received vibrations into analog electrical stroke output signals. Another function is to provide a structure that maintains the bounce-back of the drumstick even when hitting the striking surface 12 directly on top of the central vibration communication chain VCC4 or directly on top of the cushioning member 80 of the related art.

However, the cushioning member 80 shown in FIG. 9 features the mechanical property of energy absorption, thereby absorbing some of the vibration energy induced by a stroke in the drumhead 12. This energy absorption is especially evident when an input stroke is given exactly on the drumhead center 12C, thus directly on top of the cushioning member 80. Energy absorption as a property is highly disadvantageous especially in multi-sensor electronic percussion device configurations since some of the energy of the input stroke is absorbed by the cushioning member 80, Therefore, other sensors that are not disposed directly under the location of the input stroke will return a stroke signal readout, which is not in proportion with the actually applied input stroke intensity. In contrast with the cushioning member 80, the central vibration communication chain VCC4 equipped with the resilient helicoidal spring 4SP, fully preserves the vibration energy by returning vibrations back to the drumhead 12. As explained hereinbelow, energy return to the drumhead 12 is of prime importance since it allows for the correct vibration intensity level to be detected by the peripheral sensors 8*p* since the vibration energy is not absorbed by the helicoidal spring 4SP or by the piston 4PST. In other words, with the embodiments of the present invention, the vibration energy induced by an input stroke is not absorbed by the vibration transfer mechanism, or vibration communication chain VCC, but is fully communicated to the sensors 8 to permit the derivation of correct input stroke readings.

As noted hereinabove, the related art suffers from a detrimental problem by which input percussion strokes received on the drumhead center 12C, or in a circular area having a radius of about 1.5 centimeters concentric to the drumhead center 12C, produce stroke output signal levels considerably higher than those of input strokes received outside of this area. This detrimental problem occurs because at the very center 12C, or in the central circular area, the input percussion stroke strikes directly above the cushioning member 80 that is disposed in contact with the drumhead bottom surface 12B. Thereby, far greater electrical stroke signals output is generated out of the sensor 14 which is placed underneath the cushioning member 80, as shown in the related art FIG. 9. In turn, the detected intensity level is translated into greater sound output to the user, when using a simplistic algorithm by which the output sound level is in direct proportion to the intensity detected at the stroke output signal of the central sensor 8*c*. Indeed, the problem of receiving higher signal readings from percussion strokes that are given on the center of the drumhead 12C is of physical nature and also exists with the embodiments of the present invention. However, in the embodiment 1000 of the present invention the problem from which the related art suffers is eliminated by the introduction of the second sub-algorithm. The second sub-algorithm is dedicated to the calculation of sound signal intensity, and uses a combination of two different stroke signal outputs, namely the output OUTC of the center sensor 8*c* and the output OUTP of the peripherals sensors 8*p*.

The idea underlying the second sub-algorithm for intensity detection is to use the position detection estimation in conjunction with the intensity readout of the stroke output signal received by the sensors 8*c* and 8*p*. The intensity detection algorithm imparts less weight or less effect to the sound intensity calculation derived from the stroke output signal OUTC, which is coupled to the center sensor 8*c*, when an input stroke is received directly on or in the proximity of the striking surface center 12C. Likewise, more weight or more effect is imparted to the sound intensity calculation derived from the stroke output signal OUTC, when the input stroke is received farther away from the striking surface center. Similarly, the intensity derived from the stroke output signal OUTP is given less weight when an input stroke impacts on or close to the striking surface peripheral portion 12P, and more weight to an input stroke received closer to the center of the striking surface 12C. Such an inverse relation avoids the detrimental problem described hereinabove with respect to the related art.

The inverse relation described hereinabove may be formalized as equation (5):

$$I=(R0*Ic+A*(R-R0)*Ip)/R \qquad \text{equ. (5)}$$

wherein:

A is a parameter used for controlling relative gains of the center sensor 8*c* and of the peripheral sensors 8*p*, R0 is the estimated distance separating the percussion stroke from the drumhead center 12C, as calculated in the first sub-algorithm hereinabove, R is the radial distance from the drumhead center 12C to the peripheral carrier 2, Ic is the intensity derived from the stroke output signal OUTC by finding the maximum value of the current percussion stroke, described in the extraction procedure feature hereinbelow, Ip is the intensity derived from the stroke output signal OUTP by finding the maximum value of the current stroke, described by the feature extraction procedure detailed hereinbelow, and finally, I is the calculated signal intensity of the output sound signal.

As a check, for an input stroke at the drumhead center 12C, R0 is zero and the output intensity determined by equation (5) is A*Ip, which is completely determined by the peripheral sensors 8*p*, disregarding the non-proportional intensity Ic detected at the drumhead center. Likewise, for an input stroke received on top of the peripheral carrier 2, R0 will be equal to R, and thus the output intensity will be Ic, disregarding the non-proportional intensity Ip detected by the peripheral sensor 8*p*. It may now be better understood why it is mandatory to provide a central vibration communication chain 4 with a helical coil spring 4SP instead of the cushioning and energy absorbing member 80 recited by the related art. Should the central vibration communication chain VCC4 have absorbed some of the vibration energy when an input stroke is received directly on top thereof, then the peripheral sensors 8*p* would produce an incorrect stroke signal output level. Such an incorrect stroke signal output level would result in an incorrect calculation of the input stroke intensity ultimately adversely affecting the volume of the sounds that are sounded as output to the user. Since the central vibration communication chain VCC4 does not absorb vibration energy, the problem related to intensity detection as observed in the related art is inexistent with the embodiments of the present invention.

Figure 16A:
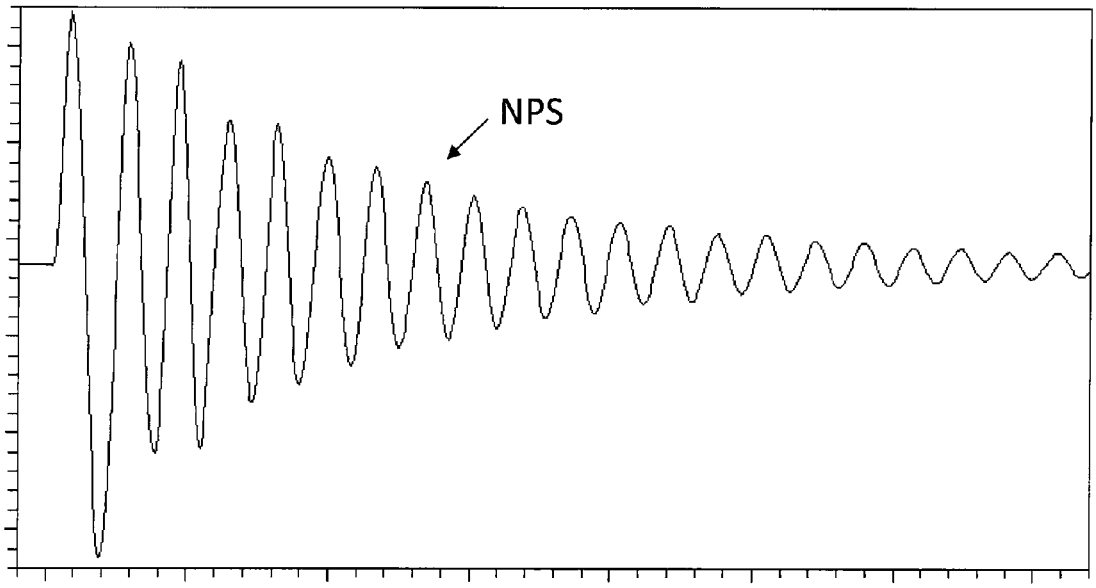
FIG. 16A and FIG. 16B show a plot of, respectively, a normal percussion stroke and a rim shot.
Figure 16B:
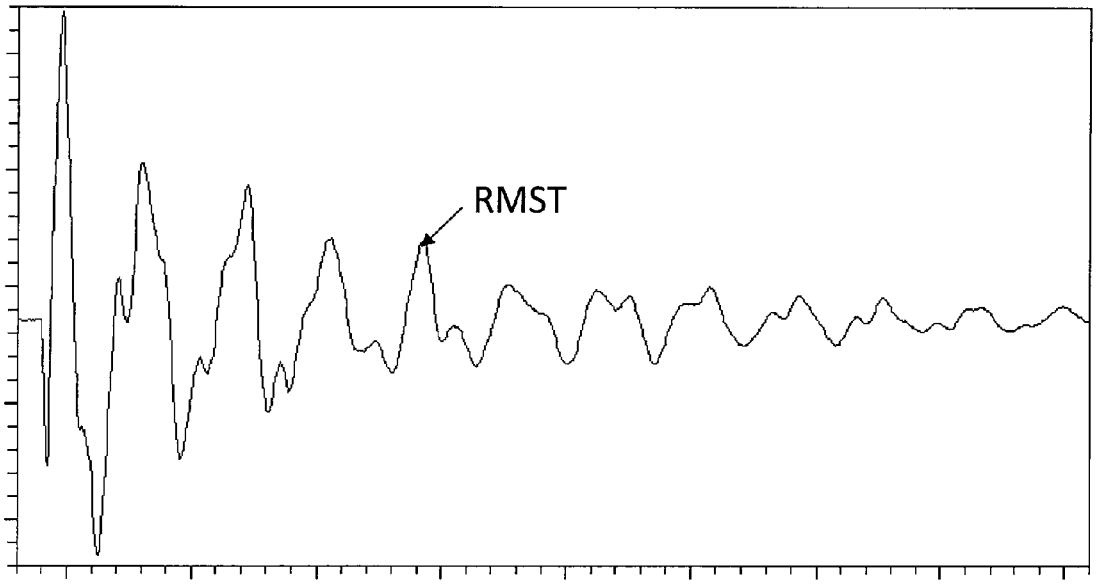
Figure 17:
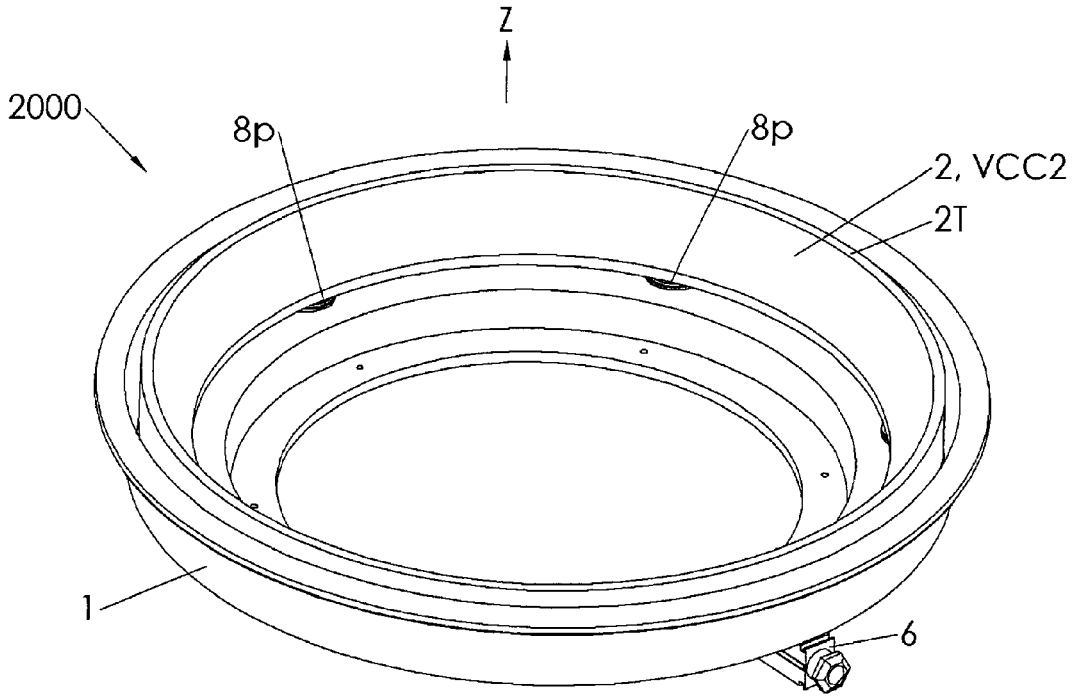
FIGS. 17 and 18 show an embodiment having only a peripheral vibration communication chain.
Figure 18:
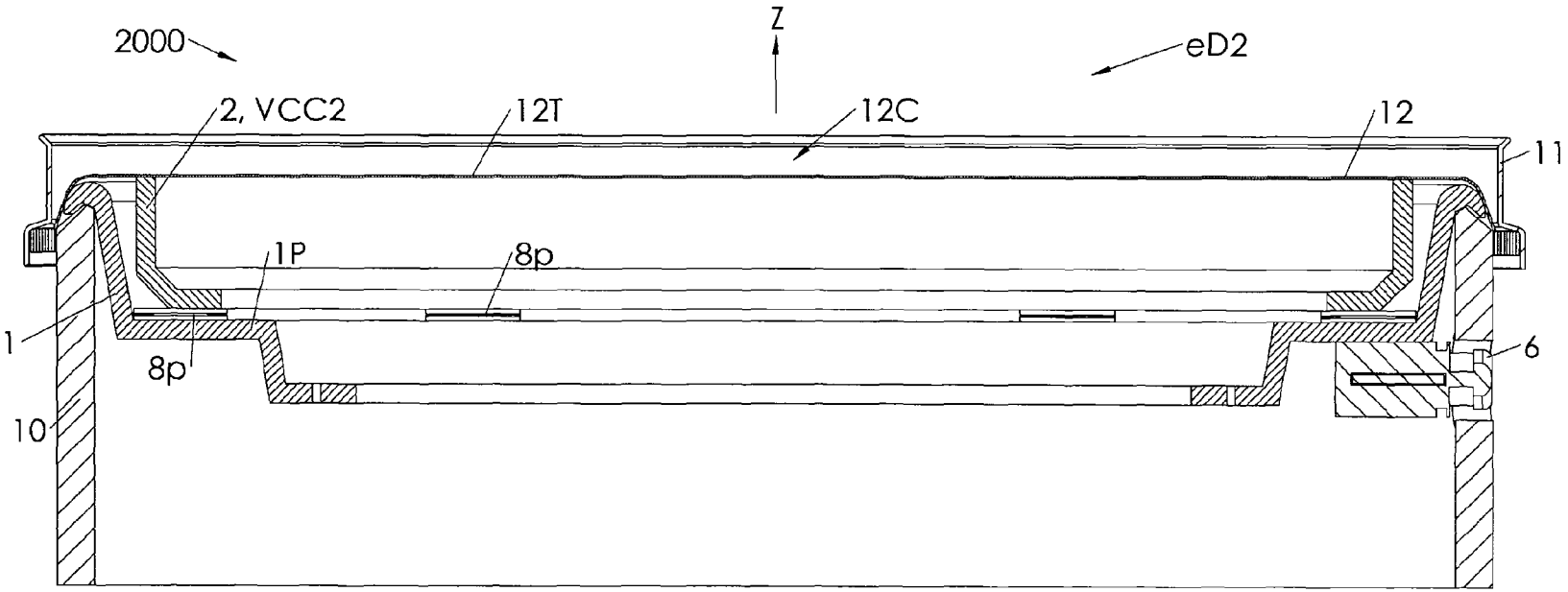

Following is a description regarding rim shot detection, where a drumstick strikes the rim edge 11R. Reference is made to FIG. 16A, which shows a plot of a normal percussion stroke NPS received on the striking surface 12, and to FIG. 16B, which shows a plot of a rim shot RMST received only on the rim edge 11R. Both plots depict stroke signal outputs captured by the peripheral sensors 8*p*, coupled to the striking surface 12 by the peripheral carrier 2. The normal drum stroke waveform shown in FIG. 16A and the rim shot depicted in FIG. 16B are quite different, but the feature distinguishing between the two waveforms is the opposite polarity displayed right at the beginning of the waveforms. With the normal percussion stroke shown in FIG. 16A, the plot rises above equilibrium level while for the rim shot, the plot starts by falling below the equilibrium level. The signal is considered to reside in an equilibrium state when void of received signals, thus when no strokes signals are received on the striking surface 12, or by the analog-to-digital converter 105. It is possible to determine whether a percussion stroke impinges on the drumhead 12 or on the rim 11 by examining or analyzing an equilibrium level of the received electrical signal at the initial moment of reception of the stroke. In case the signal is rising above the equilibrium level, determining that the stroke was induced on the drumhead, and in case the signal is falling below the equilibrium level, determining that the stroke was induced on the rim.

A similar behavior is found at the stroke signal output of the center sensor 8*c* and is also disclosed in the related art when a head sensor 14 located under cushioning member 80 is used, as shown in the related art FIG. 9, with the exception that the polarities are reversed. However, with the introduction of the peripheral carrier 2 and of the peripheral sensors 8*p*, the results obtained have a far greater signal-to-noise ratio SNR, when compared to configurations having but a single sensor 8, such as a center sensor 8*c*, thereby reducing the chance of false rim shots detection.

With the first embodiment 1000, the percussion stroke position information was derived by calculating the time difference between the arrival time of the vibration signal to the center sensor 8*c* and to the peripheral sensors 8*p*. In contrast to the first embodiment 1000, in the second embodiment 2000, position information is extracted by examination or analysis of the carrier frequency of the stroke output signal OUTP that reaches the peripheral sensors 8*p*. As described hereinabove, the high signal-to-noise ratio SNR and the averaging nature of the peripheral sensors 8*p* coupled to the peripheral carrier 2 allows for reliable extraction of features that permit the position detection procedure to produce reliable and consistent results.

It is noted that the position estimation in the embodiment 1000 will in general be more accurate than in the embodiment 2000, at the expense of a more complex system. Nevertheless, percussion stroke position estimation in the embodiment 2000 of the present invention still provides fairly good results that may be used with percussion devices such as tom-tom drums or floor drums for example.

Figure 19:
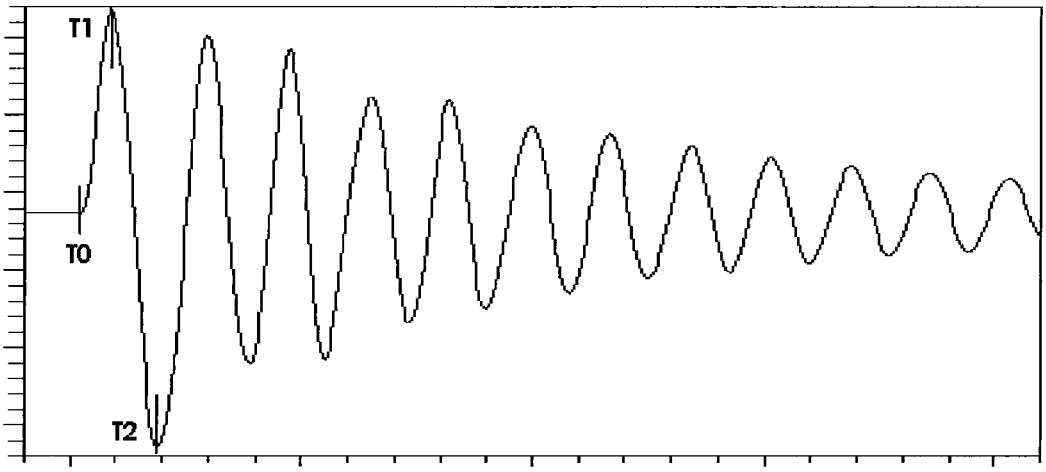
FIG. 19 shows an exemplary waveform of the signal detected by the peripheral sensors.

FIG. 19 shows a exemplary waveform 19 of the signal OUTP detected by the peripheral sensors 8*p*, with markings of the times T0, T1, T2 which represent respectively, the vibration wavefront arrival time to the signal processing unit SPU, the time at which the wavefront reaches its first maximum, and the time at which the wavefront reaches its first minimum. The position detection algorithm for the second embodiment 2000 uses the time difference (T2−T1) as a measure proportional to the radial distance of the input percussion stroke with respect to the drumhead center 12C. Experiments show that the minimal value of (T2−T1) occurs when percussion strokes are given on the drumhead main portion 12M, gradually increasing in value when moving towards the edges of the striking surface where the maximal value of (T2−T1) is obtained.

Denoting Tmin and Tmax as the minimal and maximal values of (T2−T1), one obtains:

$$R=C*K*((T2-T1)-T\min)/T\max, K=1+(I/I\max) \quad \text{equ. (6)}$$

where in equation (6):

C is a constant, which determines the number of different values R may obtain, and which is typically set to 128, K is a parameter in the range of 1 to 2 that is proportional to the intensity of the input percussion stroke signal Ip, derived from the stroke output signal OUTP, and Imax is a constant having the value of the strongest detectable stroke signal, which is typically the maximum A/D output.

It was measured empirically that equation (6) shows a variation in the resulting radial position R with different stroke output signal intensities, and therefore the factor K was introduced for compensation of this phenomenon. The parameters Tmin and Tmax are obtained through a calibration step where the user is instructed to strike on the drumhead center 12C and on the striking surface peripheral portion 12P of the striking surface 12 respectively. Tmin is simply the minimal value of (T2−T1), that is detected by a percussion stroke striking the drumhead center 12C of the striking surface 12, while Tmax is the maximal value of (T2−T1), detected following an input stroke received on the edges of the striking surface 12, namely in the striking surface peripheral portion 12P, as shown in FIG. 7. Similar to the calibration step of embodiment 1000, in the embodiment 2000 too, the detected value of R is presented to the percussionist during calibration to aid with the tuning process of the percussion device eD. It is during calibration that the percussionist iteratively adjusts the tension of the drumhead 12 by operating the drum bolts 17, and by striking on the edges of the striking surface 12 at different angular locations, while striving to receive readings of R that are as close as possible to each other. When the percussionist is satisfied with the results, the last value of (T2−T1) is saved as Tmax.

It is noted that the derivation of the values of T0, T1 and T2 shown in FIG. 19, will be introduced hereinbelow by the feature and extraction procedure step S13 shown in FIG. 13.

The sub-algorithms described hereinabove are now formalized and integrated. The flowcharts shown in FIGS. 12-15 describe the audio process algorithm S10, which continuously samples the entire set of stroke output signals received from the percussion devices eD in the system EPS, and outputs pre-recorded sound to the percussionist through a sound generating device SGD in accordance with the derived stroke output signals.

Figure 12:
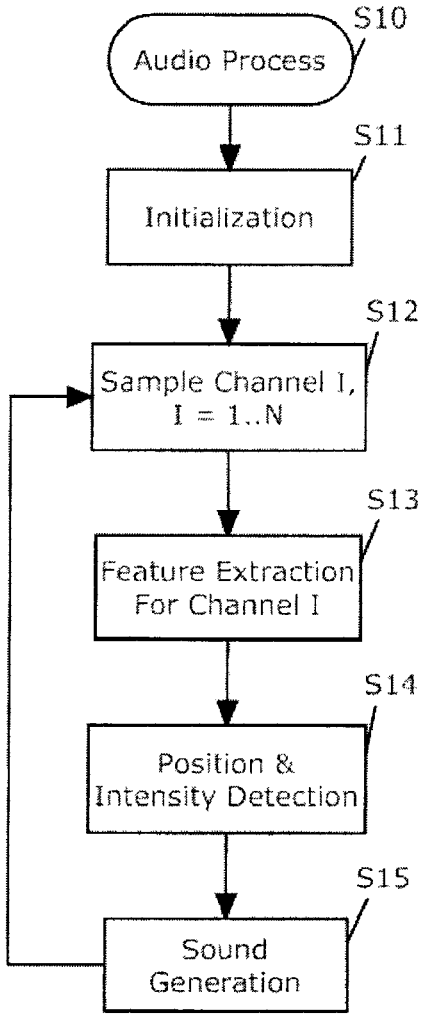
FIGS. 12-15 show flowcharts describing an audio process algorithm.

Referring to FIG. 12, the audio process program S10 starts with the power up of the processor 101, followed by an initialization procedure step S11 which sets internal variables and state machines to their initial values to indicate either default values or an idle state. Reference to the specific initial values will be made in more detail hereinbelow in relation to the description of specific procedures.

From step S11, the audio process program loops endlessly through steps S12-S15. A loop iterator I that is assigned integer values ranging from 1 to N, where N is the total number of electrical signal outputs OUTC and OUTP of the system. The loop iterator I is incrementing in circular fashion is used to select between the set of received stroke output signals. With each iteration, a different stroke output signal OUTP or OUTC, is received from the percussion devices eD, is sampled via an A/D converter 105, and undergoes two stages of processing, after which a sound may be played to the percussionist, if appropriate.

The term stroke output signal is also referred to as a channel throughout the description of the flowcharts shown in FIGS. 12-15, and may be either the output OUTC of the center sensor 8*c* or the aggregated output OUTP of the plurality of peripheral sensors 8*p*, which are also referred to, respectively, as the center channel and the peripheral channel.

The sampling process occurs at step S12 and analysis is carried out thereafter in step S13, in the context of the respective channels. The procedure of step S13 uses the current sample in conjunction with previous samples from the same channel to determine if certain features or events occurred. For example, a feature might be the detection of a newly received input stroke, or the time at which the first maximum amplitude of the stroke output signal occurred for that corresponding percussion stroke.

The results of the feature extraction procedure of step S13 do not trigger any sound output but rather serves as the input to the next procedure step S14. The procedure step S14 carries the higher level task of combining features received from several channels for the extraction of stroke position and of stroke intensity pertaining to a specific percussion device eD of the percussion system EPS. The procedure step S14 operates on the current channel I, which may be a stroke signal output emanating either from a center sensor 8*c* or from the peripheral sensors 8*p*. The procedure step S14 first retrieves the second channel for the particular percussion device eD to which the channel I belongs. Thereafter, an analysis of features and of data from the two channels, namely the center channel and the peripheral channel, is carried out to reach a decision regarding which sound the sound generating device SGD should output.

The results of the procedure step S14 become input commands for the sound generation step S15. The input commands are updated several times after the initial decision, where each successive update provides a more accurate estimate regarding the actual sound signal to be played. The incremental update procedure is carried out for a short period of time of about one millisecond, starting at the initial playback of an output sound and lasting until the full intensities from both channels have been derived. Thereby, this procedure minimizes the time delay, which starts with at the moment at which an input stroke is received on the striking surface 12, and ends with the generation of a sound.

The procedure step S15 handles all sound generation details according to commands received from the procedure step S14. These include the retrieval of pre-recorded sound signals out of the non-volatile storage memory 103, multiplication of the retrieved sound signals by a gain factor, and sending of the multiplied sound signals to the D/A converter 106, which then forwards the resulting output sound signals to the sound generating device(s) SGD, i.e. the percussionist's headphones and/or loudspeakers. It is noted that the sound generation in step S15 is void of inherent intelligence and does not participate in an algorithmic decision making process. However, the sound generation step is a computationally demanding component in the system since the embodiments of the present invention may output up to four sounds in response to a single input percussion stroke.

The loop of steps S12-S15 is carried out endlessly, scanning all the channels in round-robin fashion, thus allowing for multiple percussion devices eD as well as other devices, to be connected to a single signal processing unit SPU It was noted hereinabove that each sample undergoes two levels of processing. The first level of processing is a feature extraction stage S13 in which the sample is analyzed in the context of its own channel to derive certain features of the waveform thereof. The second level of processing is performed in step S14, which merges information from two channels from the same percussion instrument eD in order to detect new percussion strokes that were delivered by the user, and if such detection is made, to produce an estimate of the position and intensity according to these percussion strokes.

Figure 13:
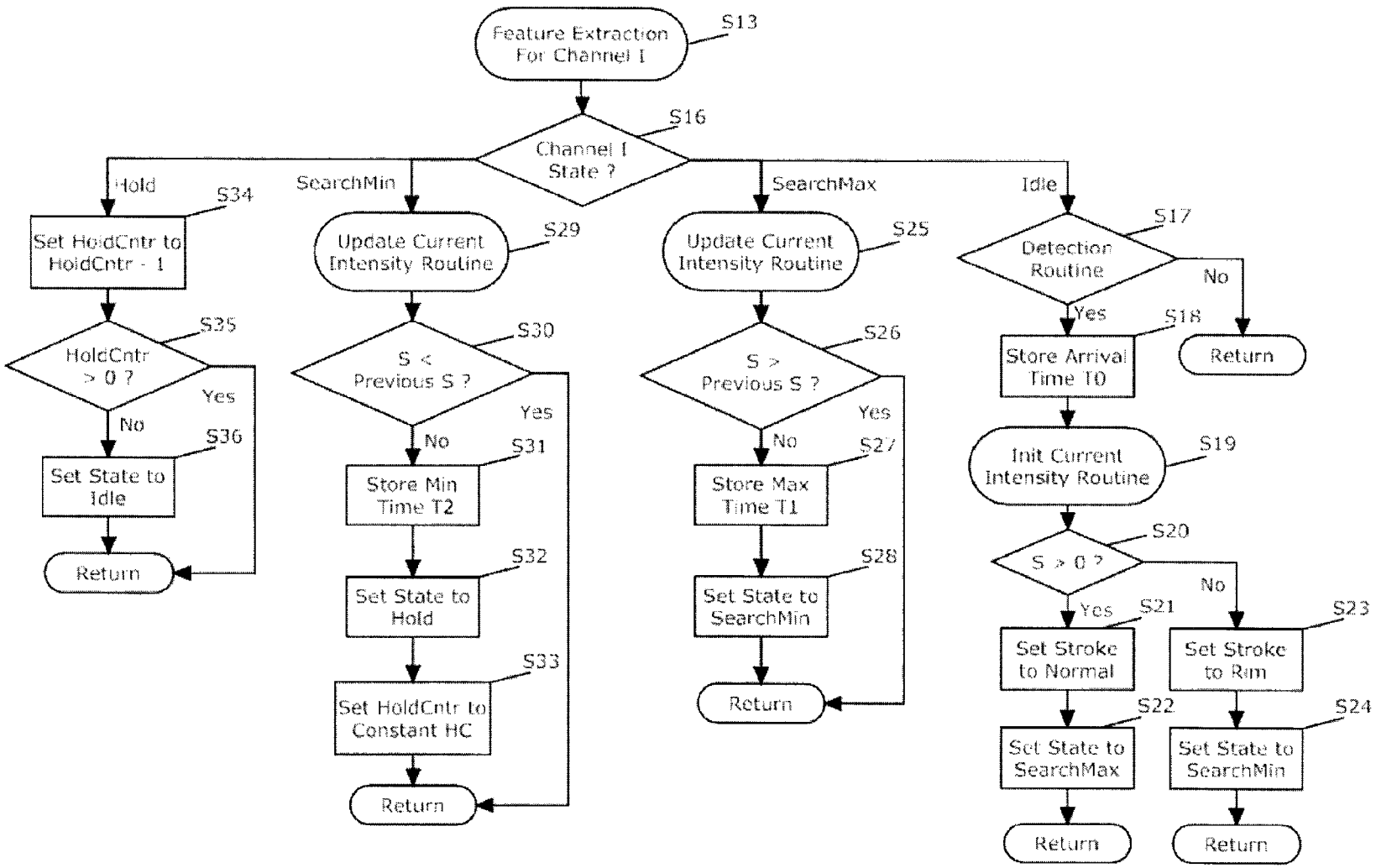

Reference is now made to FIG. 13 where the feature extraction procedure step S13 is described in detail, starting operation with a new sample received from an arbitrary channel I. The procedure S13 analyzes the signals received for derivation of the following features:

A. New stroke detection
B. Time measurement of the moment of detection of a new percussion stroke
C. Determination of positive or negative stroke output signal levels immediately after detection of a new percussion stroke signal
D. First maximum stroke output signal level time measurement and corresponding maximum stroke output signal intensity
E. First minimum stroke output signal level time measurement and corresponding minimum stroke signal intensity
F. Decay analysis of vibrations after a stroke output signal is detected It should be emphasized that not all of the features listed from A to F are used for every channel but rather form a superset from which subsequent higher-level algorithms may select a subset of features to operate thereon. Furthermore, as noted hereinabove, some of these features may only be reliably extracted in association with the aggregated stroke signal output produced by the peripheral sensors 8*p* due to their inherent averaging and high SNR properties. The procedure step S13 in the embodiments of the present invention nevertheless calculates all of the features listed from A to F regardless of the selected channel because the resultant algorithm is easier to implement and maintain, and also because the additional computational power required is rather low.

To facilitate the extraction of the features A to F listed hereinabove, the procedure step S13 holds a state variable to keep track of the current channel context. As shown in FIG. 13, this state variable has four allowable states, namely Idle, SearchMax, SearchMin, and Hold. The Idle state occurs between percussion strokes when the stroke output signal received is at its equilibrium level, while the program is searching for a new stroke output signal. The state variable is initialized by procedure step S11 to the Idle state after power up for each one of the channels in the system. When the procedure step S13 is called with a newly received sample, and the state is still in Idle, the sample enters the detection routine step S17 that is shown in FIG. 15.

Figure 15:
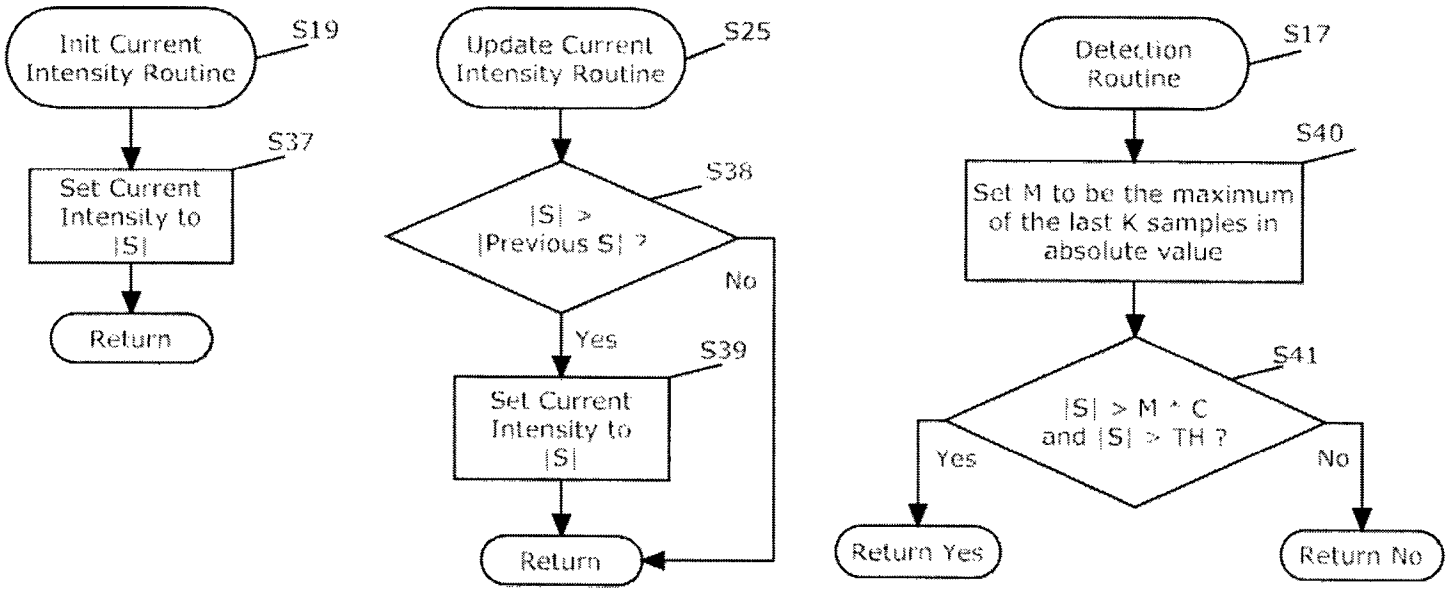

In FIG. 15, the detection routine step S17 essentially calculates a mathematical formula for measuring the quietness of the current channel. Referring to steps S40 and S41, the first criterion used is a comparison between the absolute value |S| of the current sample and the mean M that is computed over the absolute values of the last K samples, which are multiplied by some constant C having a typical value of 2. The parameter K is set such that at least one full period of the sampled waveform is searched, whereby the current sample is essentially compared to the maximum of previous values over at least one period. Since the parameter K is related to the fundamental vibration frequency of the drumhead 12, K is dependent mostly on the size of the percussion instrument eD and on the material and the tension of the striking surface 12. However, in order to simplify the program, no attempt is made to determine K accurately, instead the value of K is enlarged on purpose by 50%-100% to assure that at least one full period of the sampled waveform is fully contained within K samples. For example, a typical value that suffices for K is 30, valid for example for a sampling rate of 4 KHz and a 12" sized electronic percussion device eD.

As shown in step S41, the second criterion for the detection of a new input stroke requires that |S|>TH, which is a comparison of the absolute value of the current sample with some threshold TH. Lower values of TH result in higher sensitivity, which allows for the detection of stroke output signals having lower intensities while also being more susceptible to noises. TH is essentially a triggering parameter, set to be the lowest possible value while still being set well above the noise level of the current channel.

Returning to FIG. 13 it can be seen that if the detection routine in step S17 did not find a new stroke output signal, the feature extraction procedure step S13 remains in the Idle state and simply returns. However, if the detection routine step S17 has detected a new stroke output signal, then the algorithm proceeds to step S18, where the time of arrival T0 of the new stroke is stored since it is one of the features to be used subsequently. At step S18, only the arrival time of the vibration wavefront is known while its maximum intensity still needs additional time to fully develop and be detected by the sensors, respectively 8*c* and 8*p*.

It has been mentioned hereinabove that in order to minimize the time delay between the moment of an input stroke arriving at the striking surface 12 and the moment of initial sound reproduction, the algorithm uses the current value of the received stroke signal intensity, which will subsequently be updated to the accurate final value as time elapses. As shown in FIG. 15A, the procedure step S19 sets the initial value of the detected intensity of the stroke signal to become the absolute value of the current sample. The procedure step S19 operates in conjunction with procedure step S25, also shown in FIG. 15, which updates the detected intensity of the stroke signal to become the maximum absolute value of all the samples received since the detection of the new percussion stroke within the stroke signal. It will be shown hereinbelow exactly when the procedure S25 is called for, but for now it is important to realize that the detected stroke signal intensity, updated by steps S19 and S25, is a feature that may be used by subsequent higher level algorithms in the process.

Returning to FIG. 13 after the call to step S19, there is a decision step S20 which determines whether the current detected percussion stroke is a normal stroke that was induced by a hit on the striking surface 12, or a rim shot that was induced by hitting the rim edge 11R. Although this feature is calculated for both the center sensor 8*c* and the peripheral sensors 8*p*, as respectively OUTC and OUTP, signal strokes of a given percussion device eD, it uses only on the OUTC channel of the peripheral sensors 8*p* since the higher signal to noise ratio SNR achieves a more reliable result than for the output channel of the center sensor 8*c*. As discussed hereinabove, if the signal is rising, thus positive at the initial moment of start of a stroke output signal, then the detected percussion stroke is a normal stroke and the algorithm proceeds to step S21. Else, if the signal is falling, hence negative at that initial moment of the start of the stroke output signal, then the detected percussion stroke is a rim shot and the algorithm proceeds to step S23.

In step S21 the feature C as defined hereinabove is updated with the value of a normal stroke output signal, and since the stroke output signal is rising, the algorithm proceeds to step S22 where the state variable is updated to the SearchMax state. In step S23, where a stroke output signal having a negative polarity has been detected, the feature C is updated to a value fitting a rim shot, which value is to be used later, and since the stroke output signal is falling below equilibrium level, the next state is set to SearchMin in the next step S24. When step S13 will be called again later on with the same channel index I, the process depicted in the flowchart on FIG. 13 will start to operate on the next sample either in SearchMin or in SearchMax. The purpose of both SearchMin and/or SearchMax is to repeatedly update the current stroke signal intensity value of the current channel in order to improve the estimation accuracy of higher level algorithms defined in step S14.

When a new sample S arrives and the feature extraction procedure S13 is entered with state SearchMax, first an update is made to the detected intensity of the stroke signal of the present sample S in procedure step S25, and then the exit condition step S26 is checked to determine if the stroke output signal continues to rise. If the stroke output signal continues to rise, then the result of step S26 is yes and thus the procedure returns, remaining in its current state SearchMax. If however the result of step S26 is no, this means that the stroke output signal stopped rising and that the maximum value was already reached. In that last case, the time T1 is stored in step S27 and in the next step S28, the state changes to SearchMin, to track the time of occurrence of the first minimum.

The state SearchMin operates in a similar fashion as state SearchMax, starting with step S29, updating the intensity of the stroke signal of the present sample S and then checking in step S30 for the occurrence of a minimum. If the current sample S continues to drop lower below the previous sample, then the minimum has not yet been found and therefore, the result of step S30 is yes and the procedure returns, still remaining in the same state SearchMin. If on the other hand the result is no, then the program proceeds to step S31 and the time T2 is stored as the time of occurrence of the first minimum.

At this point the feature extraction stage has completed all its objectives for obtaining features for higher level processing and enters a Hold state at step S32, which employs an automatic rejection of further stroke output signals. This is mandatory since the first maximum of the stroke output signal is not always the highest one and hence, subsequent maxima generated by the same stroke output signal might erroneously trigger a second stroke output signal. The Hold state introduces a counter variable HoldCntr that is initialized to some constant HC in step S33. With each new sample that arrives to the Hold state, the counter variable HoldCntr is decremented by 1 in step S34. Typically, the counter HoldCntr variable needs to count for a long enough time so as to allow the next two or three maxima to elapse. However, the counter HoldCntr must not count too much as the detection of a subsequent stroke output signal might be missed. A typical value 12 that accounts for a delay of 3 milliseconds at a sampling rate of 4 KHz might be a good candidate for HoldCntr. The test or exit condition out of the Hold state is preformed in step S35, returning to the Idle state in step S36, right after the counter HoldCntr reaches the value zero.

Figure 14:
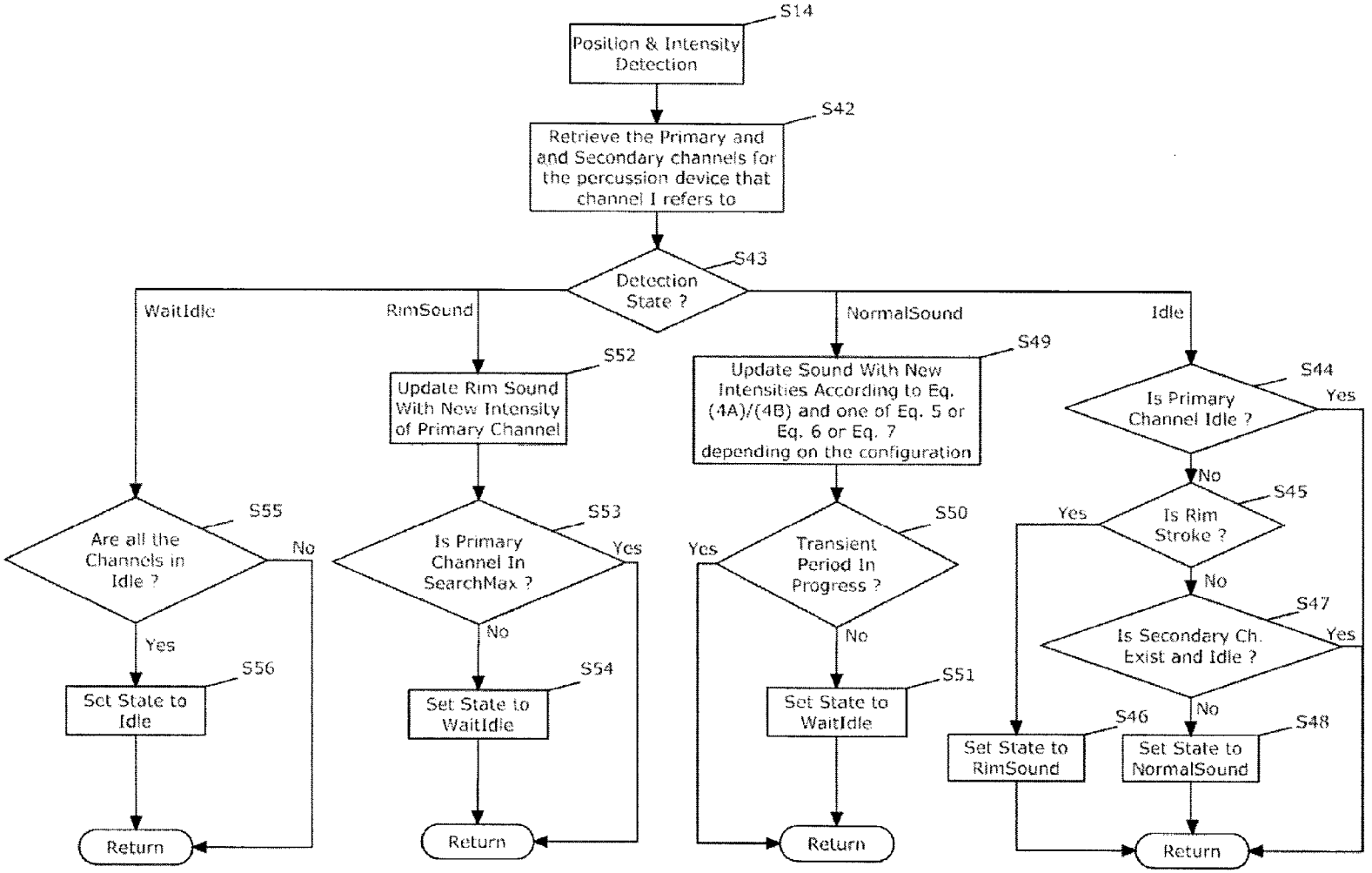

The Feature Extraction procedure step S13 described hereinabove is followed by the Position and Intensity Detection procedure step S14, as shown in FIG. 14. This procedure analyzes the features obtained by step S13 from the peripheral and central channels that belong to the same percussion device eD. The procedure at step S14 then calls the sound generation routine in step S15 to output the sound that needs to be played to the user.

It is noted that step S14 holds the only differences in the program that is operating on the various embodiments of the present invention and furthermore, that the differences in step S14 between these embodiments are minor, thereby allowing for the same process to suit all the embodiments of the present invention. The following notations are now accepted with regard to the description of the operation of the procedure step S14. The term primary channel is used to denote the peripheral channel which is the stroke output signal OUTP that is output from the percussion devices eD1 and eD2 that are defined according to the embodiments 1000 and 2000, respectively. In the embodiment 3000, which has no peripheral vibration communication chain VCC2, the term primary channel refers to the central channel, which is also referred as the stroke output signal OUTC. Similarly, the term secondary channel is used to denote the central channel, or OUTC, for the percussion device eD1 as defined by the embodiment 1000. The secondary channel does not exist in the embodiments 2000 and 3000.

The procedure step S14 shown in FIG. 14 is called upon arrival of a new sample S for each channel I in the main program loop. The channel I may be either a primary channel or a secondary channel, so first step S42 finds the other channel that is used by the percussion device eD that is associated with the channel I. In other words, if the channel I is a primary channel of a specific percussion device eD in the system EPS, then step S42 will retrieve the secondary channel for that particular percussion device, if it exists. If the secondary channel does not exist, as is the case in the embodiments 2000 and 3000, then the secondary channel is ignored. In similar fashion, if the channel I is a secondary channel of a specific percussion device eD in the system EPS, then step S42 will retrieve the primary channel for that that particular percussion device. Therefore, after step S42, the features and state of both the primary channel and the secondary channel, if existent, are known for the percussion device eD associated with the channel I.

The next step of the procedure is determined at crossroad step S43 using a state variable that is held on a per percussion device basis, which is a distinct state variable that is not to be confused with the state variable of each channel shown in FIG. 13. The state variable used in step S14 is initially set to the Idle state in the initialization procedure step S11. If in step S43 the current state is Idle, then control is passed to step S44 where the primary channel is checked for the features of a new stroke output signal.

As described hereinabove and shown in steps S17-S24 in FIG. 13, should a new stroke output signal be detected, then the state of the primary channel would not be Idle. Furthermore, after the detection of a new percussion signal feature, it is also known whether the percussion stroke is a normal percussion stroke or a rim shot. If in step S44 the state of the primary channel is Idle, then the function returns, preserving the Idle state of the procedure step S14. However, if the state of the primary channel is not Idle, then control is passed to step S45 where the channel is checked for detection of a normal percussion stroke or of a rim shot. In the embodiments 1000 and 2000, the primary channel is defined to be the peripheral channel and therefore, the decision between a normal percussion stroke and a rim shot is made with excellent results. In the embodiment 3000, it is the central channel that is checked so that the decision is made with good results, although not as good as with the embodiments 1000 and 2000. Should the primary channel accept the percussion stroke as a rim shot, which is shown in step S23 in FIG. 13, then the procedure sets the state variable to RimSound in step S46 and returns, starting the process of initiating a pre-recorded rim sound in the next iteration. If however step S45 returns no, which implies that a normal percussion stroke was detected, then control is passed to step S47 to determine whether the secondary channel is existent and if so, if it has also detected a percussion stroke.

It is important to note that in the case of embodiment 1000, a rim shot is detected entirely by the peripheral sensors 8*p* coupled to the peripheral carrier 2, while a normal percussion stroke requires detection from both the peripheral sensors 8*p* of the peripheral carrier 2 and of the center sensor 8*c*. When testing the state of the central channel in step S47, if it is Idle then the procedure returns without passing any commands to the sound generator step S15 since the moment of arrival from both sensors 8*c* and 8*p* is required. However, if the state of the central channel in step S47 in non-Idle, then the program proceeds to step S48 where the state variable is set to NormalSound and returns. However, in the case of embodiments 2000 and 3000, since there is provided only one stroke output signal from the percussion device, such signal is the only channel available for decision of either initiating the process of output of a normal percussion sound or of a rim shot.

The process continues to step S49, which is called iteratively in a loop of the main audio process when the state is set to NormalSound, where each new iteration updates the sounds that are generated with a more accurate estimation. This is done until the transient period elapses for all the channels available with the current percussion device. For the embodiment 1000 and 3000, this occurs when the available channels exit the SearchMax state, at which point both maximum values of the sound signals are known, and the position and intensity results are accurate. For the embodiment 2000, the transient period elapses only after exiting the SearchMax and SearchMin state, as will be described hereinbelow.

As described hereinabove, the estimation process in step S49 was introduced in order to minimize the delay, knowing that it is much more important to output an inaccurate sound signal as quickly as possible and to care for an update later on, rather than to wait until all the features of the sound signal arrive, and only then to generate an accurate sound signal. The estimation of the output sound signals is performed in procedure step S49, where the specific equations used for the sound signals to be generated are chosen according to the features available on each one of the embodiments, and also according to the processing power capabilities of the processor 101.

Starting with embodiment 1000, first the percussion radial position R0 is computed using equation (3). In addition, step S25 of the feature extraction procedure S13 is used to derive intensities Ic and Ip, of respectively the central and peripheral channel. Thereafter, the computed radial position R0 and the intensities Ic and Ip are applied to equation (5) to produce the calculated intensity I. The resultant computed intensity I and radial position R0 of the input percussion stroke are then used as an input to the equations (4A), (4B) and (5) for derivation of a suitable sound generation as described hereinabove. For a high performance processor 101 embedded within the signal processing unit SPU, capable of generating four sounds per stroke output signal, one may use the equations (4A) and (5) for the computation of the output sound. However, for a lower performance processor 101 capable of outputting only two sounds per stroke output signal, one may use equations (4B) and (5). In case of an even lower performance processor 101, capable of outputting only one sound signal per stroke output signal, one would choose the nearest neighbor of the sounds S1-S4 shown in FIG. 11A and use equation (5) for the stroke intensity signal. The following equations used for the embodiment 1000 related to the computation described hereinabove are now repeated for convenience:

$$R0=R*(t1-t2+T)/(2*T) \quad \text{equ. (3)}$$

$$\text{Output Sound}=(S1*R2*I2+S2*R1*I2+S3*R1*I1+S4*R2*I1)/((R1+R2)*(I1+I2)) \quad \text{equ. (4A)}$$

$$\text{Output Sound}=(S1*R2+S2*R1)/((R1+R2)) \quad \text{equ. (4B)}$$

$$I=(R0*Is+A*(R-R0)*Ip)/R \quad \text{equ. (5)}$$

In the case of embodiment 2000, the step S49 uses the equation (6) for the computation of the radial position R, and the intensity Ip is the calculated by step S25 of the feature extraction procedure S13. The resulting radial position R and stroke intensity Ip and then input to either the equation (4A) or equation (4B) for generation of a suitable output sound, in the same manner as described hereinabove for the embodiment 1000. Equation (6) described hereinabove is repeated here for convenience:

$$R=C*K*((T2-T1)-T\min)/T\max, K=1+(I/I\max) \quad \text{equ. (6)}$$

In the case of embodiment 3000, the radial position is not calculated, so only one sound is used for output, with varying intensity Ic of the central cannel, as calculated by step S25 of the feature extraction step S13. Therefore, any chosen pre-recorded sound can be used in step S49 according to the user's preferences.

The estimation process in step S49 terminates when the crossroad step S50 returns no, which occurs when the transient period elapses as described hereinabove. Otherwise, when step S50 returns yes, the procedure step S14 returns true, thereby staying in the state NormalSound state to service future samples to be received and to update the output of pre-recorded sounds. When step S50 returns no, the program proceeds to step S51 where the WaitIdle state is set. The WaitIdle state assures that a second trigger signal will not falsely occur by waiting for the primary channel and for the secondary channel, if existent, to enter the idle state before allowing a next output of a pre-recorded sound. As shown in step S55, if the primary channel or the secondary channel, if existent, do not reside in the Idle state shown in FIG. 13, then the WaitIdle state is retained and no further triggering of additional pre-recorded sounds may occur. If however all the channels of the current percussion device channels are in the Idle state, then control is passed to step S56 where the state of the procedure step S14 is changed back to Idle.

Referring back to procedure step S52 in the RimSound state, it is noted that the commands to the sound generator step S15 are updated each time step S52 is called in accordance with the maximum level of the primary channel detected so far. The maximum level is computed in step S25, which is called in the feature extraction procedure S13 described hereinabove. The process termination condition tested in step S53 is the exit of the primary channel from the SearchMax state, at which point an accurate result is obtained based on the maximum value detected in the primary channel.

There is thus provided a method for detecting a radial position and an intensity of a percussion stroke induced in an electronic percussion device eD, and for generating an electrical signal of a percussion sound, which correspond to the detected position and the intensity of the percussion stroke. The method comprising the steps from (a) to (g):

(a) providing a drumhead 12 having a striking surface 12T for receiving vibrations induced by the percussion stroke, the drumhead having a bottom surface 12B opposite the striking surface, (b) providing an electrical first signal in response to vibrations received on the drumhead and collected at a center 12C thereof, (c) providing an electrical second signal in response to vibrations received on the drumhead and collected thereon from a plurality of locations which are distributed at equal and a predetermined distance away from the center of the drumhead, (d) providing an electronic module, comprising a processor 101 and a memory 102, for receiving the first and the second signals and for producing an output signal in response to the first and the second signals, (e) computing a radial location of the percussion stroke on the drumhead based on detection of a time of arrival of the first signal and of the second signal, (f) computing the intensity of the percussion stroke as a weighted sum of a maximum amplitude of the first signal and of the second signal, (g) generating an electrical signal representative of a percussion sound by using the computed radial location and intensity of percussion to select and sound at least one pre-recorded percussion sound that was stored a priori in memory.

The step of calculating the radial location further comprises the following steps:

(a) detecting the time of arrival of the percussion stroke on the first signal, (b) detecting the time of arrival of the percussion stroke on the second signal, and (c) computing a radial distance result by applying a proportion factor to a difference in time of arrival of the percussion stroke on the first signal and on second signal, and adding half of the predetermined distance.

The step of calculating the intensity of the stroke may further comprise the following steps:

(a) detecting a first amplitude as the maximum amplitude of the percussion stroke received on the first signal, (b) detecting a second amplitude as the maximum amplitude of the percussion stroke received on the second signal, (c) computing a normalized radial location having a value ranging between zero and one by dividing the radial location result by the predetermined distance, (d) setting a proportion ratio as a predetermined constant for compensating differences in signal amplification of the first signal and of the second signal, and (e) computing the intensity of the stroke as a sum of a first term and of a second term, the first term being a multiplication of the first amplitude with the normalized radial location and the second term being a multiplication of three sub-terms, the first sub-term being the second amplitude, the second sub-term being one minus the normalized radial location, and the third sub-term being the proportion ratio.

Evidently, the memory 102 is a computer readable medium storing instructions that, when executed by a computer 101, cause the computer to perform each of the method steps described hereinabove.

There is also provided a method for detecting a location of a percussion stroke impinging on an electronic percussion device eD, having a drumhead 12 and a rim 11, where the percussion stroke is received on the drumhead or on the rim, and generating in response a corresponding percussion sound signal. The method comprises the steps of providing a peripheral carrier 2 for receiving vibrations from a plurality of locations on the drumhead, and providing an electrical signal in response to vibrations received from the peripheral carrier, where the electrical signal has an equilibrium level that is void of vibrations, thus a level at which no vibrations are detected. The method further comprises the steps of determining whether the percussion stroke impinges on the drumhead or on the rim. This is achieved by one of the steps of examining the received electrical signal at an initial moment of reception of the stroke. In case the signal is rising above the equilibrium level, determining that the stroke was induced on the drumhead, and examining the received electrical signal at the initial moment of reception of the stroke, and in case the signal is falling below the equilibrium level, determining that the stroke was induced on the rim. Thereafter, the method comprises the step of generating a corresponding percussion sound signal in response to reception of the percussion stroke on the drumhead or on the rim.

Regardless of the description hereinabove, the peripheral vibration communication chain VCC2 is not necessarily circular. The vibration communication chain VCC2 may be configured as a tubular carrier body 2TUB centered on the drumhead center 12C and configured to have to a carrier periphery of arbitrary even irregular closed loop shape, running adjacent and close to the periphery of the striking surface 12. Thereby, the vibration communication chain VCC2 divides the striking surface into two portions, as described hereinabove. Hence, even though not circular, a good quality stroke intensity signal and strike location will be provided.

The vibration communication chain VCC2, or peripheral carrier 2 is disposed interior to a periphery interior 1 IN of the sensors support, and the carrier periphery 2P is supported adjacent the sensors support, not shown in FIG. 24, but without contact therewith.

It will be appreciated by persons skilled in the art, that the present invention is not limited to what has been particularly shown and described hereinabove. Rather, the scope of the present invention is defined by the appended claims and includes both combinations and subcombinations of the various features described hereinabove as well as variations and modifications thereof which would occur to persons skilled in the art upon reading the foregoing description.

What is claimed is:

1. A method for detecting a radial position and an intensity of a percussion stroke induced in an electronic percussion device, and for generating an electrical signal of a percussion sound which corresponds to the detected position and the intensity of the percussion stroke, the method comprising:

providing a drumhead having a striking surface for receiving vibrations induced by the percussion stroke, the drumhead having a bottom surface opposite the striking surface;

providing an electrical first signal in response to vibrations received on the drumhead and collected at a center thereof;

providing an electrical second signal in response to vibrations received on the drumhead and collected thereon from a plurality of locations which are distributed at equal and a predetermined distance away from the center of the drumhead;

providing an electronic module, comprising a processor and a memory, for receiving the first and the second signals and for producing an output signal in response to the first and the second signals;

computing a radial location of the percussion stroke on the drumhead based on detection of a time of arrival of the first signal and of the second signal;

computing the intensity of the percussion stroke as a weighted sum of a maximum amplitude of the first signal and of the second signal;

generating an electrical signal representative of a percussion sound by using the computed radial location and intensity of percussion to select and sound at least one pre-recorded percussion sound stored in a memory.

2. The method according to claim 1, wherein the computing the radial location comprises:

detecting the time of arrival of the percussion stroke on the first signal;

detecting the time of arrival of the percussion stroke on the second signal; and computing a radial distance result by applying a proportion factor to a difference in time of arrival of the percussion stroke on the first signal and on second signal, and adding half of the predetermined distance.

3. The method according to claim 1, wherein the computing the radial location comprises:

deriving a radial location of the percussion stroke received on the striking surface by application of a computer program for computation of equation:

$$RO=R*(t1-t2+T)/(2*T)$$

wherein:

RO is the resultant radial location, defined as the distance separating the drumhead center away from the percussion stroke location;

R is the predetermined distance;

t1 is the time of detection of the percussion stroke on the first signal;

t2 is the time of detection of the percussion stroke on the second signal; and T is a predetermined constant.

4. The method according to claim 1, wherein the computing the intensity of the stroke comprises:

detecting a first amplitude as the maximum amplitude of the percussion stroke received on the first signal;

detecting a second amplitude as the maximum amplitude of the percussion stroke received on the second signal;

computing a normalized radial location having a value ranging between zero and one by dividing the radial location result by the predetermined distance;

setting a proportion ratio as a predetermined constant for compensating differences in signal amplification of the first signal and of the second signal; and computing the intensity of the stroke as a sum of a first term and of a second term, the first term being a multiplication of the first amplitude with the normalized radial location and the second term being a multiplication of three sub-terms, the first sub-term being the second amplitude, the second sub-term being one minus the normalized radial location, and the third sub-term being the proportion ratio.

5. The method according to claim 1, wherein the computing the intensity of the stroke comprises:

deriving an intensity of the percussion stroke received on the striking surface by application of the at least one computer program for computation of equation:

$$I=(RO*Ic+A*(R-RO)*Ip)/R$$

wherein:

I is the calculated intensity of the percussion stroke;

A is a predetermined constant for compensating differences in signal amplification of the first signal and of the second signal;

RO is the resultant radial location, defined as the distance separating the drumhead center away from the percussion stroke location;

R is the predetermined distance;

Ic is a detected maximum amplitude of the percussion stroke received on the first signal; and Ip is a detected maximum amplitude of the percussion stroke received on the second signal.

* * * * *